US005716047A

United States Patent [19]

Ohkoda et al.

[11] Patent Number: 5,716,047

[45] Date of Patent: Feb. 10, 1998

[54] RECORDING OR READING APPARATUS AND SHEET SUPPLY DEVICE WITH DRIVE SYSTEM HAVING FIRST AND SECOND MECHANISMS

[75] Inventors: Keiji Ohkoda, Yokohama; Tomohiro Kudo, Tama, both of Japan

[73] Assignee: Canon Kabushiki Kaisha, Tokyo, Japan

[21] Appl. No.: 412,716

[22] Filed: Mar. 29, 1995

[30] Foreign Application Priority Data

Mar. 31, 1994 [JP] Japan ..... 6-062959
May 24, 1994 [JP] Japan ..... 6-109695

[51] Int. Cl.[6] ..... B65H 3/46

[52] U.S. Cl. ..... 271/106; 271/107

[58] Field of Search ..... 271/5, 11, 106, 271/107

[56] References Cited

U.S. PATENT DOCUMENTS

| | | | |
|---|---|---|---|
| 3,370,845 | 2/1968 | Newcomb | 271/107 |
| 3,466,028 | 9/1969 | Bays | 271/106 X |
| 3,980,292 | 9/1976 | Sakurai | 271/107 X |
| 4,992,815 | 2/1991 | Kudo . | |
| 5,052,672 | 10/1991 | Horii | 271/11 X |
| 5,151,713 | 9/1992 | Kawasaki et al. . | |
| 5,350,166 | 9/1994 | Shimizu et al. . | |
| 5,560,596 | 10/1996 | Okoda et al. | 271/106 |

FOREIGN PATENT DOCUMENTS

| | | | |
|---|---|---|---|
| 4200393 | 7/1993 | Germany | 271/11 |
| 71435 | 4/1985 | Japan | 271/11 |

*Primary Examiner*—Boris Milef
*Attorney, Agent, or Firm*—Fitzpatrick, Cella, Harper & Scinto

[57] ABSTRACT

An apparatus for recording or reading information on or from a sheet is disclosed. The apparatus includes a holding unit for holding a sheet, a first arm which has one end pivotally fixed to the holding unit, a second arm whose one end or a specific point is pivotally fixed to the first arm, and a driving system. The driving system can integrally move the other end of the first arm and the other end of the second arm, and can change the interval between the other end of the first arm and the other end of the second arm. The apparatus also includes a posture regulating mechanism for regulating the posture of the holding unit with respect to the first arm, a sheet supply unit provided with the holding unit, the first arm, the second arm, the driving system, and the posture regulating mechanism, and a recording or reading unit for performing information recording or information reading on a sheet supplied to the sheet supply unit.

26 Claims, 16 Drawing Sheets

RECORDING OR READING APPARATUS AND SHEET SUPPLY DEVICE WITH DRIVE SYSTEM HAVING FIRST AND SECOND MECHANISMS

BACKGROUND OF THE INVENTION

1. Field of the Invention

The present invention relates to a recording or reading apparatus for recording or reading an image onto or from a sheet, and a sheet supply device for supplying a sheet suitable for the recording or reading apparatus.

2. Related Background Art

Conventionally, a sheet supply device has been widely used in an image recording apparatus, an image reading apparatus, and various other apparatuses, and devices with various structures and various supply methods are known. In addition, various means for realizing the function of a sheet supply device, i.e., the function of picking up one of a large number of stacked sheets, are available. In the case of devices for paper sheets, each sheet is normally picked up using a rubber roller. On the other hand, in the case of devices for films, since a sheet film has a surface roughness lower than that of a paper sheet, and tends to generate a static electricity, the attraction force between each two adjacent sheets is large when the sheets are stacked. Therefore, a method of peeling off one sheet by reducing the pressure inside a suction pad by, e.g., an electromagnetic pump is often used.

Various mechanisms for bringing the suction pad close to or away from a sheet in this case are known. For example, a suction pad moving mechanism in a sheet supply device shown in FIG. 1A is known. Referring to FIG. 1A, a sheet supply device 301 is arranged above a supply magazine 302 in which a large number of sheet films are stacked. A sheet is supplied to a pair of rollers 304 one by one while being sucked by a suction pad 303, and is then fed to an image recording/reading unit (not shown). The suction pad 303 is attached to a slide base 305, which is movable in the horizontal direction, via arms 306 and 307, and a hinge 308. The arms 306 and 307 engage with a guide groove 310 fixed to the sheet supply device via a guide pin 309. The guide groove 310 is defined by an upper guide groove **310*a* and a lower guide groove 310*b*. By switching a guide bar 311, the guide pin 309 is guided to a desired one of the guide grooves 310*a* and 310*b*. When the guide pin 309 is guided to the guide groove 310*b*, then the suction pad 303 moves toward the sheet film side, and when the guide pin 309 is guided to the guide groove 310*a*, then the suction pad 303** moves toward the pair of rollers.

FIG. 1B shows another conventional sheet supply device. A suction pad holding member 411 is supported to be vertically movable and to be pivotal about a given axis. Nipples 412 and 413 are fitted into the holding member 411, and suction pads 414 and 415 are respectively attached to the lower ends of the nipples 412 and 413. The suction pad holding member 411 is coupled, via pins 416 and 417, to the lower ends of arms 419 and 420 which are supported to cross each other and to be pivotal about a pin 418. The pin 416 is pivotally inserted in a holding hole **411*a* of the suction pad holding member, and the pin 417 is pivotally and slidably inserted in a guide hole 411*b*. The upper ends of the arms 419 and 420 are held by an arm support member 423 via pins 421 and 422, respectively. In this case as well, the pin 421 is pivotally and slidably inserted in a guide hole 423*a* of the member 423, and the pin 422 is pivotally inserted in a holding hole 423*b*. With this structure, the suction pad holding member 411 is supported to be parallel to the arm support member 423**, and is movably held in a direction to approach/separate from the arm support member.

The arm support member 423 is rotatably supported by a pivot shaft 424, and the pivot shaft 424 is pivotally supported by a frame (not shown). A gear 427 is fixed to one end of the arm support member 423, and meshes with a gear 429 of a first driving source 428. On the other hand, a gear 430 is fixed to one end of the pivot shaft 424, and meshes with a gear 432 of a second driving source 431. A thread portion is formed on a portion, concealed by the arm support member 423, of the pivot shaft 424. In the arm support member 423, a slider (not shown) extends through and is supported by the pivot shaft to be slidable in the axial direction. A nut (not shown) fixed to one end of the slider is threadably engaged with the thread portion formed on the pivot shaft. The lower portion of the slider is coupled to the pin 421.

With this arrangement, when the first driving source 428 is deactivated, and the second driving source 431 is activated, the pivot shaft 424 pivots to pivot its screw portion, and the slider (not shown) moves in the axial direction. Upon movement of the slider, the pin 421 slides in the guide hole **423*a*, and the arms 419 and 420 pivot about the pin 418, thus vertically moving the suction pad support member 411. On the other hand, when both the first and second driving sources 428 and 431 are activated to pivot the pivot shaft 424 and the arm support member 423 at the same angular velocity, the support member 411 pivots about the pivot shaft 424 while maintaining a constant interval with the pivot shaft 424**.

FIG. 2 shows an example of a sheet convey apparatus having the sheet supply device with the above arrangement.

Referring to FIG. 2, a laser optical unit 1311 deflects a laser beam **1311*a*, which is modulated in accordance with an image signal, using a polygonal mirror, and optically scans a film surface in the main scanning direction. A pair of sub-scanning rollers 1312 are arranged below the laser optical unit 1311, and convey a sheet clamped therebetween at a constant speed with high precision, thus attaining sub-scanning for image recording. A supply magazine 1313 for storing a stack of non-recorded sheets, and a receive magazine 1314 for storing recorded sheets are arranged below these recording means. A suction pad 1315 has a vertically movable mechanism, and picks up sheets from the supply magazine one by one. Roller pair units 1316 and 1319 are direction switching rollers which convey a sheet clamped between rollers, and controls the traveling direction of a sheet when planetary rollers 1317 and 1320 rotate around corresponding main rollers 1318 and 1321. At positions K and Q, the planetary rollers 1317 and 1320 can be separated from the corresponding main rollers 1318 and 1321, and be moved to positions L and R. A sheet registration member 1325 is used for skew registration and registration of a sheet, and its contact surface contacting the leading edge of a sheet is parallel to the main scanning line of the laser beam. Sheet guide plates 1326 and 1327** have a small frictional resistance, and guide a conveyed sheet.

The operation of an image recording apparatus with the above arrangement will be described below. When the supply magazine 1313 is loaded to a predetermined position in the apparatus main body, the suction pad 1315 is activated to pick up the uppermost sheet, and the picked-up sheet is inserted between the direction switching rollers 1316. When the planetary roller 1317 moves around the main roller 1318 at the same angular velocity from the position J to the position K simultaneously with the rotation of the main roller 1318, the traveling direction of the leading edge of the sheet is directed toward the upper second direction switching rollers 1319. When the main roller 1318 is further rotated, the sheet travels upward along the guide plate 1326, and is clamped between the second direction switching rollers 1319. The second direction switching rollers 1319 similarly convey the sheet clamped therebetween while changing the direction of the sheet by making the same motion as the above-mentioned direction switching rollers 1316. In this case, when the planetary roller 1320 moves from the position P to the position R via the position Q to be separated from the main roller 1321, the sheet travels upward while contacting the planetary roller 1320 due to its stiffness, and the leading edge portion of the sheet is directed in the direction of the registration member 1325. When the main rollers 1318 and 1321 are driven to rotate in this state, the sheet is conveyed by the first direction switching rollers 1316 while being clamped therebetween, or is moved forward by the second direction switching rollers 1319 by a frictional force generated by the stiffness and weight of the sheet itself although the planetary roller 1320 is separated therefrom. In this manner, the sheet is brought into contact with the registration member 1325. By further moving the sheet forward, the entire leading edge of the sheet contacts the registration member 1325, and as a result, the sheet is registered to be parallel to the main scanning direction of the light beam 1311*a*. At this time, since the sheet is moved forward while its leading edge contacts the registration member 1325, a deformation occurs on the trailing end side of the sheet, but is absorbed by a portion with a low stiffness of the sheet, as indicated by an alternate long and two short dashed line in FIG. 2.

After the registration is completed, the planetary roller 1320 is returned from the position R to the position Q, and the main roller 1321 is rotated in a direction opposite to the registration member 1325, thereby directing the sheet toward the sub-scanning rollers 1312 while maintaining a parallel state.

When the main roller 1321 is rotated in the reverse direction again, and the sheet is clamped between the sub-scanning rollers 1312, a sub-scan is immediately started, and at the same time, the light beam 1311*a* is irradiated from the optical unit 1311, thereby forming a predetermined image on the sheet. Upon completion of recording, the sub-scanning rollers 1312 begin to rotate in the reverse direction, and the sheet on which a latent image is recorded is conveyed in a direction opposite to the sub-scanning direction. After the sheet is clamped between the second direction switching rollers 1319 again, the planetary roller 1320 moves to the position S. With this operation, the leading edge of the sheet is directed toward the receive magazine 1314, and is fed into the magazine.

However, as a sheet supply device, a demand has arisen for a device which has a simpler structure and easier control than those of the first prior art which requires a cam switching operation, and which is suitable for vertical and horizontal movements as compared to the second prior art which is mainly vertically movable.

SUMMARY OF THE INVENTION

It is an object of the present invention to provide a low-profile sheet supply device which can solve the above-mentioned problems, has a simple structure and easy control, and is suitable for vertical and horizontal movements, and a recording or reading apparatus using the sheet supply device.

Other objects of the present invention will become apparent from the following description of the embodiments.

DESCRIPTION OF THE PREFERRED EMBODIMENTS

The preferred embodiments of the present invention will be described below with reference to FIGS. 3 to 16B.

Figure 1A:
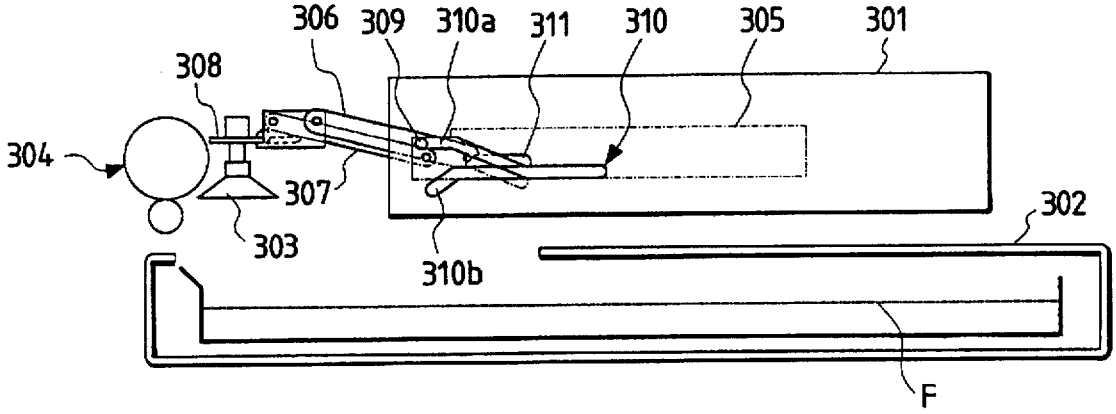
FIG. 1A PRIOR ART
FIG. 1A is an explanatory view of a conventional sheet supply device.
Figure 1B:
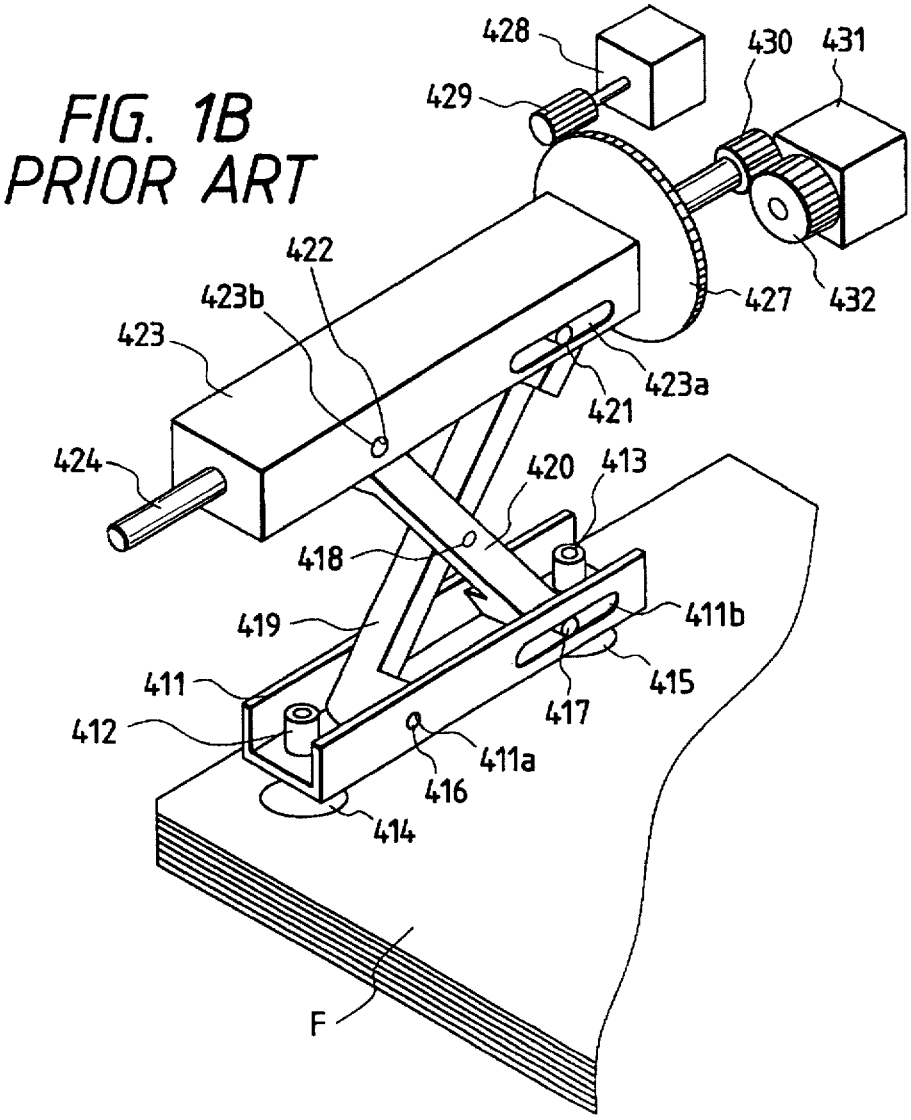
FIG. 1B PRIOR ART
FIG. 1B is an explanatory view of another conventional sheet supply device.
Figure 2:
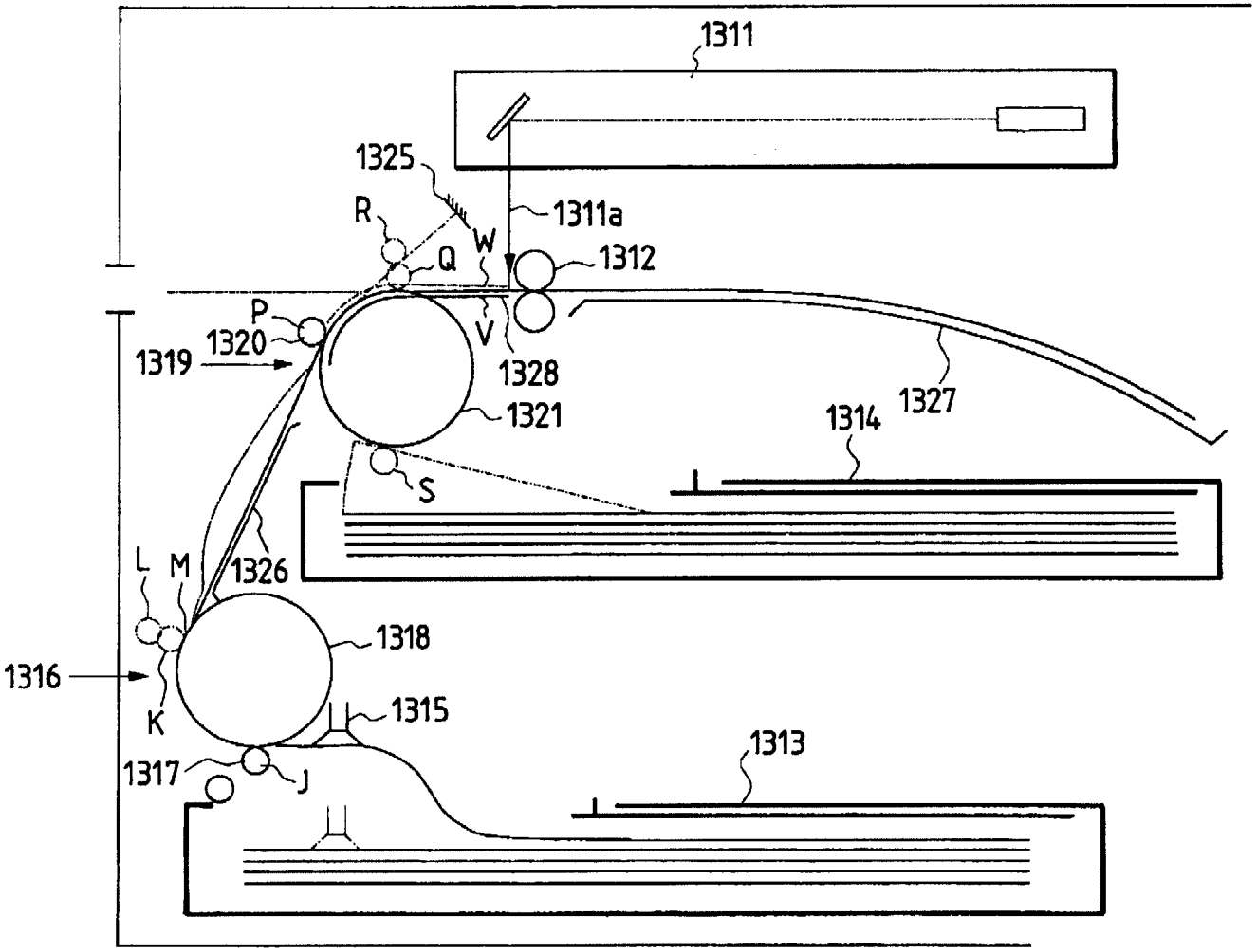
FIG. 2 PRIOR ART
FIG. 2 is an explanatory view of the conventional sheet supply device.
Figure 3:
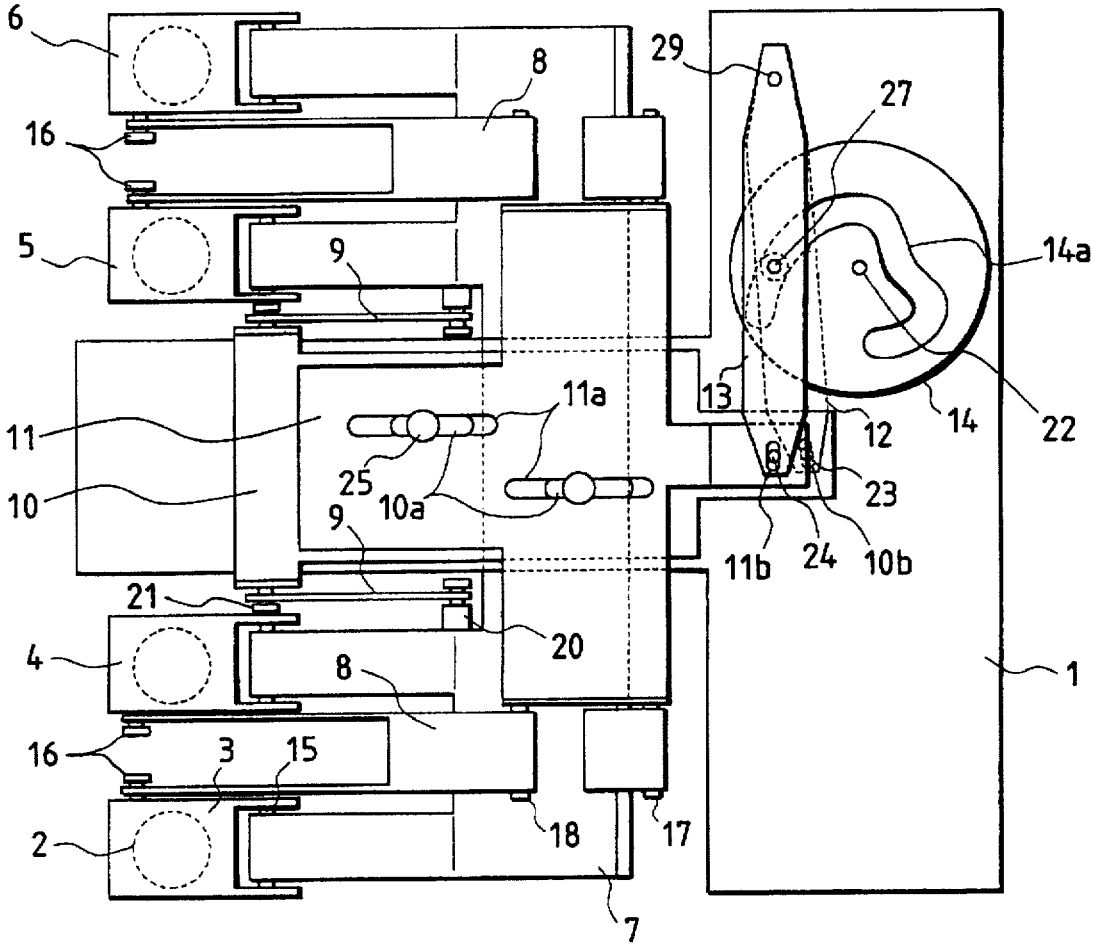
FIG. 3 is a plane view of a sheet supply device according to the first embodiment of the present invention.
Figure 4:
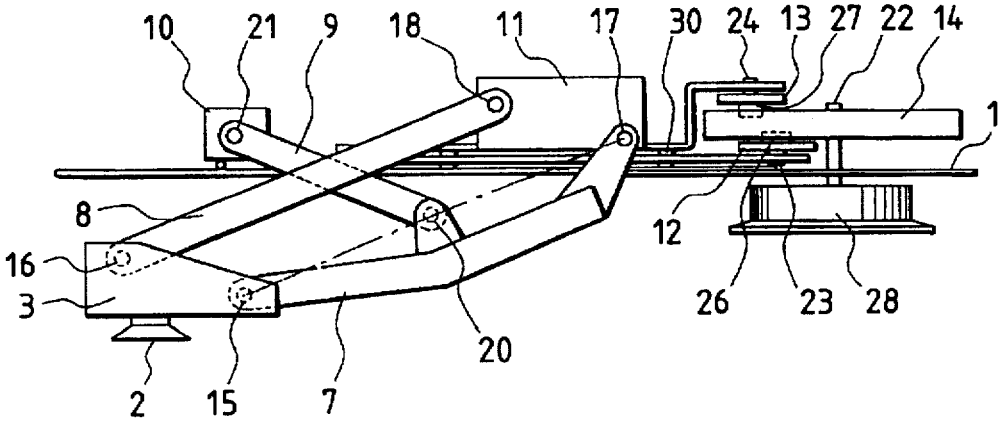
FIG. 4 is a side view of the sheet supply device according to the first embodiment of the present invention.

FIG. 3 is a plane view of a sheet supply device according to the first embodiment of the present invention, and FIG. 4 is a side view of the device. The arrangement of the device will be described below with reference to FIGS. 3 and 4. Referring to FIGS. 3 and 4, a board 1 holds respective components of the sheet supply device. Each of suction pads 2 has an exhaust port (not shown), which is connected to a pressure-reduction means such as an electromagnetic pump via a hose (not shown). The pressure inside each suction pad 2 is reduced when the suction pads 2 contact a sheet, thereby holding the sheet by suction. The suction pads 2 are fixed to suction pad support members 3, 4, 5, and 6. The lower ends of arms 7 and 8 are pivotally fixed to the suction pad support members 3, 4, 5, and 6 via pins 15 and 16. The upper ends of the arms 7 and 8 are fixed to an upper slide plate 11 via pins 17 and 18. The interval between the pins 15 and 17 is equal to that between the pins 16 and 18. Also, the interval between the pins 15 and 16 is equal to that between the pins 17 and 18. More specifically, the suction pad support member 3, the arms 7 and 8, and the upper slide plate 11 form a parallelogram link mechanism. Therefore, even when the arms 7 and 8 rotate, the suction pads 2 are always parallel to the board 1. The lower ends of arms 9 are pivotally fixed to the arm 7 via pins 20, and their upper ends are pivotally fixed to a lower slider plate 10 via pins 21. The position of each pin 20 corresponds to the middle point of a straight line connecting the pins 15 and 17, and the interval between the pins 20 and 21 is equal to half the interval between the pins 15 and 17. The lower slide plate 10 has two elongated hole portions 10*a*, and the upper slide plate 11 similarly has two elongated hole portions 11*a*. Pins 25 extend through the corresponding elongated hole portions 10*a* and 11*a*. Spacers 30 with good slidability are disposed in a contact portion between the board 1 and the lower slide plate 10, and a contact portion between the lower and upper slide plates 10 and 11. Therefore, the slide plates 10 and 11 are fixed to the board 1 to be independently slidable in the right-and-left direction in FIGS. 3 and 4. The slide plates 10 and 11 respectively have elongated hole portions 10*b* and 11*b* on their right end portions, and pins 23 and 24, which are fixed to the lower ends of levers 12 and 13, are respectively fitted in these elongated hole portions 10*b* and 11*b*. The levers 12 and 13 are fixed to the board 1 to be independently pivotal about a shaft 29. A cam disk 14 is fixed to the board 1 to be pivotal about a shaft 22. A cam groove 14*a* is formed on the upper surface of the cam disk 14. A cam follower 27 fixed to the lever 13 is fitted into the groove 14*a*. Similarly, another cam groove is formed on the lower surface (not shown) of the cam disk 14, and a cam follower 26 fixed to the lever 12 is fitted into the groove. A toothed pulley 28 is fixed to the lower end of the shaft 22. A toothed belt (not shown) is looped on the pulley 28, and rotates a rotating shaft upon reception of a driving force from a driving source (not shown), which is controlled by a control circuit (not shown), thereby rotating the cam disk.

With the above-mentioned arrangement, when the lower slide plate 10 is fixed and the upper slide plate 11 is slid in the right-and-left direction in FIGS. 3 and 4, the suction pads 2 move in only the up-and-down direction in FIG. 4. When the lower and upper slide plates 10 and 11 are simultaneously and integrally moved in the same direction, the suction pads 2 move in only the right-and-left direction in FIG. 4. When the upper slide plate 11 is fixed and the lower slide plate 10 is slid, the arm 7 rotates about the pin 17, and the suction pads 2 move along an arcuated path while maintaining a horizontal state. When the upper and lower slide plates 10 and 11 are moved at different speeds, the suction pads 2 can be moved in the up-and-down direction in FIG. 4, and their positions in the right-and-left direction in FIG. 4 can also be changed simultaneously.

Figures 9A, 9B:
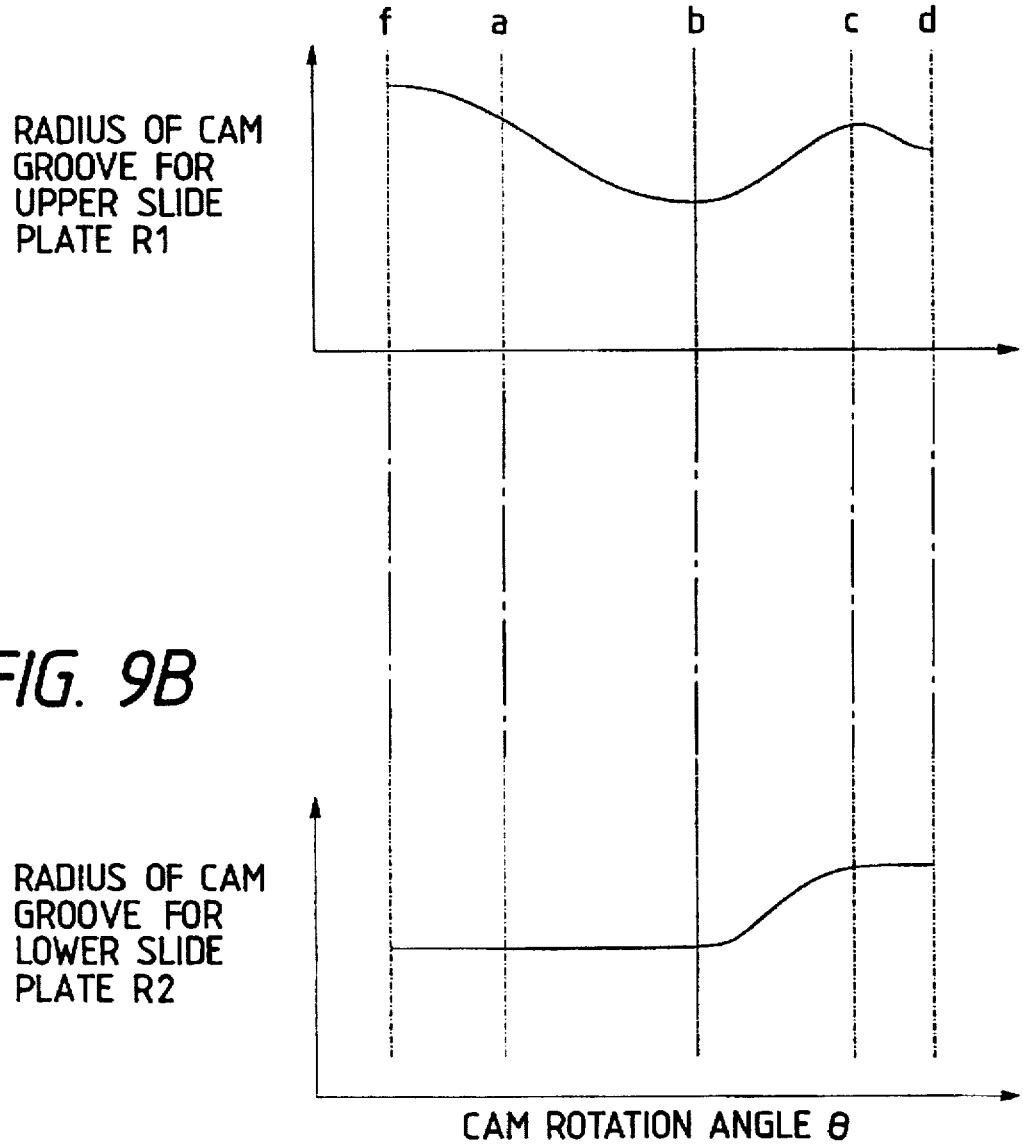
FIGS. 9A and 9B are graphs showing the relationship between the cam rotation angle and the radius of the cam groove according to the first embodiment of the present invention.

The above-mentioned movements of the suction pads are determined by the shapes of the cam grooves formed in the upper and lower surfaces of the cam disk for moving the slide plates. An example of the shapes of the cam grooves and the operation of the suction pads will be described below with reference to FIGS. 5 to 9B. FIGS. 5 to 8 are schematic views showing an example of the operation of the embodiment shown in FIGS. 3 and 4, and the same reference numerals in FIGS. 5 to 8 denote the same parts as in FIGS. 3 and 4 although the arms and the like are illustrated simply. FIGS. 5 to 8 illustrate convey rollers 29 and stacked sheets F in addition to the above arrangement. FIGS. 9A and 9B are graphs showing the relationship between the radii R1 and R2 of the cam grooves where the cam followers 27 and 26 of the upper and lower slide plates 11 and 10 are located, and the rotation angle θ of the cam disk 14. The alternate long and short dashed lines shown in FIGS. 9A and 9B indicate the rotation angles of the cam disk corresponding to suction pad positions f, a, b, c, and d shown in FIGS. 5 to 8.

Figure 5:
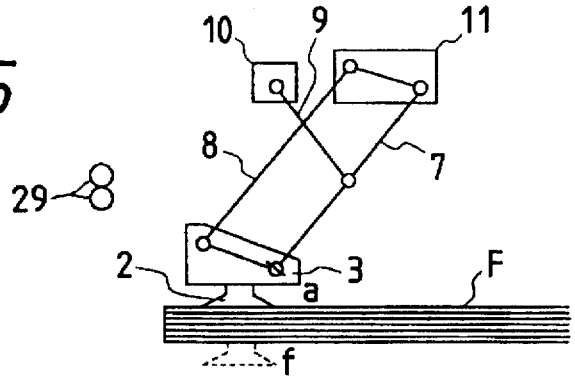
FIG. 5 is a side view for explaining the operation of the sheet supply device according to the first embodiment of the present invention.
Figure 6:
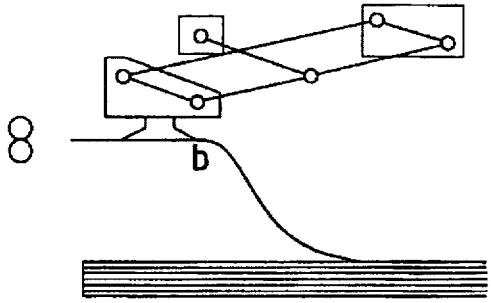
FIG. 6 is a side view for explaining the operation of the sheet supply device according to the first embodiment of the present invention.
Figure 7:
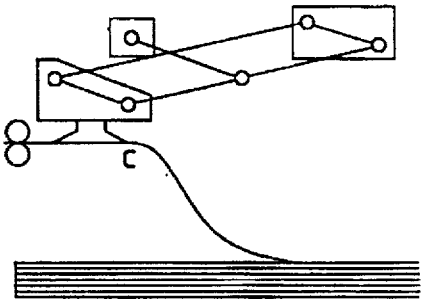
FIG. 7 is a side view for explaining the operation of the sheet supply device according to the first embodiment of the present invention.
Figure 8:
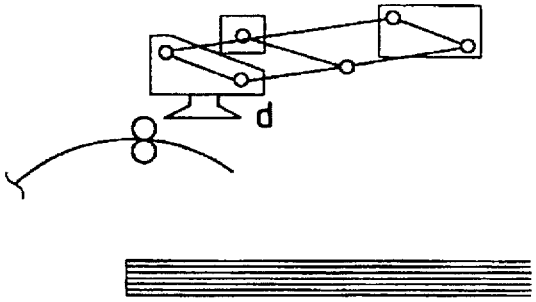
FIG. 8 is a side view for explaining the operation of the sheet supply device according to the first embodiment of the present invention.

At a position a shown in FIG. 5, the suction pads 2 contact the uppermost one of the stacked sheets F. In this state, the pressure inside each suction pad is reduced by a pressure-reduction means (not shown), thereby holding the sheet by suction. From the state a, when the cam disk 14 is rotated in a direction to increase θ (the counterclockwise direction in FIG. 3) so as to decrease only the radius R1 of the cam groove at the cam follower position of the upper slide plate 11, as shown in FIGS. 9A and 9B, the suction pads 2 move upward, and the leading edge of the sheet sucked by the suction pads moves upward to a position b (FIG. 6) at the same level as the nip portion between the convey rollers 29. When the cam disk 14 is rotated from the position b to a position c, as shown in FIGS. 9A and 9B, the radii R1 and R2 of the cam grooves at the cam follower positions of the upper and lower slide plates increase by the same amount. At this time, the suction pads 2 horizontally move to the left to the position c, and insert the leading edge of the sheet between the convey rollers 29 (FIG. 7). The pressure-reduced state of the pressure-reduction means is released to increase the pressure inside the suction pad, and the cam disk 14 is further rotated to decrease only R1, so that the suction pads 2 move upward from the position c to a position d at a desired timing, and is retracted from the sheet convey path (FIG. 8), as shown in FIGS. 9A and 9B. After one sheet is conveyed, the cam disk is rotated in the reverse direction to be returned to a position near the position a in FIGS. 9A and 9B, so that the suction pads move to a position where they contact the uppermost one of the stacked sheets F. The suction pads 2 can move downward to a position f below the position a, and can sufficiently cover a change in the number of stacked sheets. The timing at which the suction pads move downward, contact a sheet, and move upward after they draw the sheet by suction is achieved by drive-controlling the cam disk 14 to be rotated in the reverse direction when a detection means (not shown) detects a contact state between the suction pads and the sheet. At this time, the pressure-reduction means for reducing the pressure inside each suction pad is activated simultaneously. The above-mentioned rotation control of the cam disk 14 and the control of the pressure-reduction means for the suction pads are realized by a control circuit (not shown).

In this embodiment, four suction pads are arranged in correspondence with sheets of different sizes. For example, an 8"×10" size sheet can be drawn by suction using inner two suction pads, and a 14"×17" size (35 cm×43 cm) sheet can be drawn by suction using the outer two or all the four suction pads. In this embodiment, the inner and outer suction pads are coupled to different systems of pressure-reduction means, and the pressure-reduction means connected to the suction pads to be used is activated in correspondence with the size of a sheet to be drawn by suction. Alternatively, a single system of pressure-reduction means may be used, and leakage from suction pads which are not used may be prevented using solenoid valves.

Figure 10:
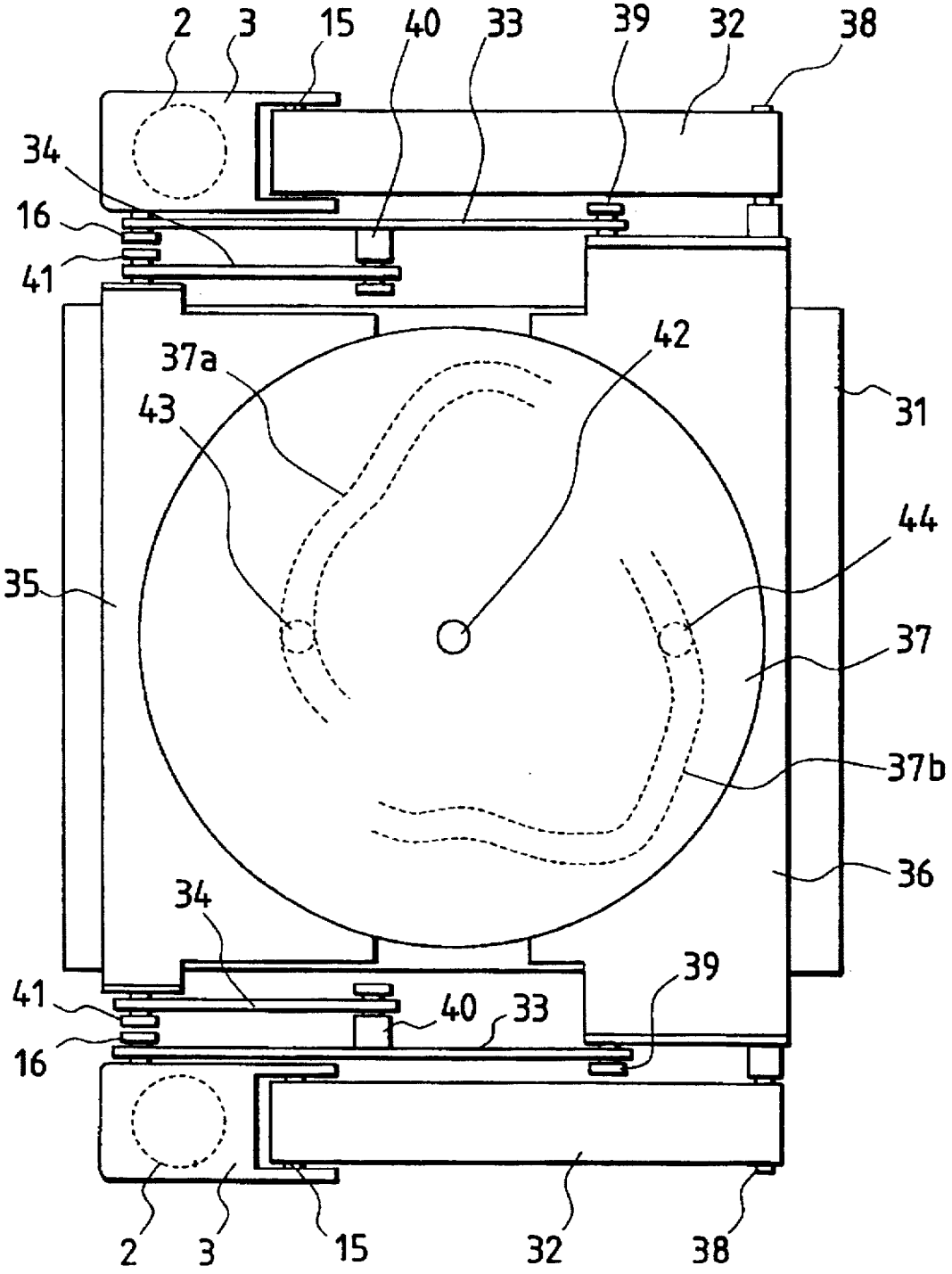
FIG. 10 is a plane view of a sheet supply device according to the second embodiment of the present invention.
Figure 11:
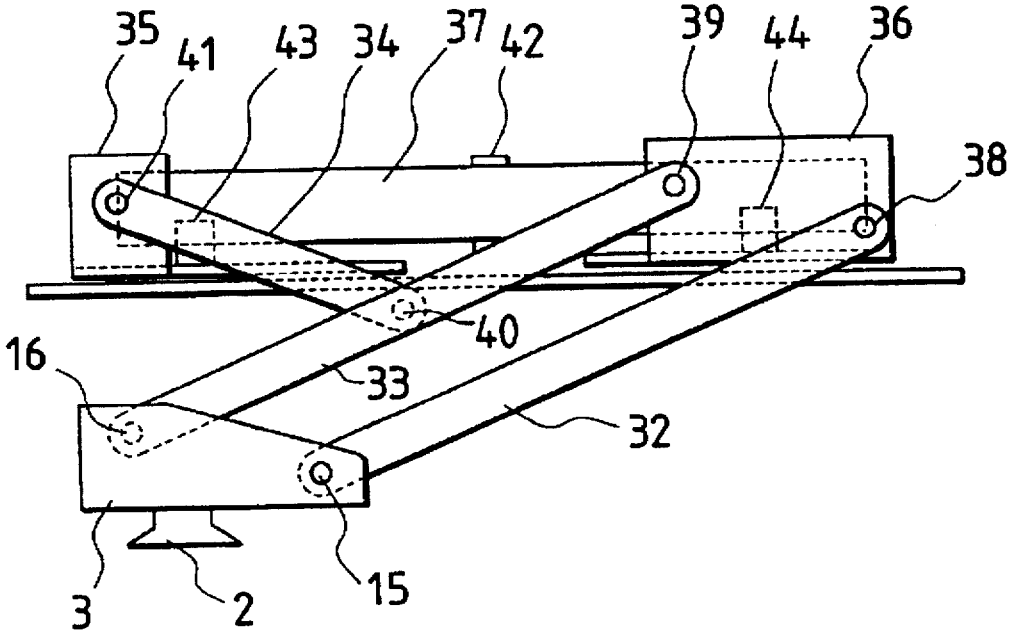
FIG. 11 is a side view of the sheet supply device according to the second embodiment of the present invention.

FIGS. 10 and 11 are respectively a plane view and a side view of a sheet supply device according to the second embodiment of the present invention. The same reference numerals in FIGS. 10 and 11 denote the same parts as in FIGS. 3 and 4. A significant difference between this embodiment and the above-mentioned embodiment is that the number of suction pads 2 is reduced to two to limit the size range of sheets to be used, but the number of parts is reduced instead to realize a compact, inexpensive arrangement.

Suction pads 2 are fixed to suction pad holding members 3, and the suction pad holding members 3 are pivotally supported by the lower ends of arms 32 and 33 via pins 15 and 16. The upper ends of the arms 32 and 33 are pivotally attached to a right slide plate 36 via pins 38 and 39. Arms 34 are pivotally attached to the middle points of the arms 33 via pins 40, and their upper ends are attached to a left slide plate 35 via pins 41. The slide plates 35 and 36 are fixed to a board 31 via members (not shown) to be slidable in the right-and-left direction in FIG. 10. Cam followers 43 and 44 are respectively fixed to the slide plates 35 and 36. The cam followers 43 and 44 are respectively fitted into cam grooves 37*a* and 37*b* formed on the lower surfaces of a cam disk 37 which is fixed to the board 31 to be pivotal about a rotating shaft 42.

The lengths of the arms 32, 33, and 34 are the same as those of the arms 7, 8, and 9 in the first embodiment. Although the lower end positions of the arms 34 are different, the relationship between the movements of the right and left slide plates 36 and 35 and those of the suction pads 2 is the same as the relationship between the upper and lower slide plates 11 and 10 and the suction pads 2 in the first embodiment. However, the levers 12 and 13 are omitted, and the right and left slide plates 36 and 35 are directly moved by the corresponding cam grooves. With this arrangement, since the moving amount of each cam follower cannot be increased by a lever, each cam groove has a large radius.

In this embodiment, by optimizing the shapes of the cam grooves, the suction pads can be moved in various paths upon driving of the cam disk using a driving source (not shown). For example, the movements of the suction pads described in the first embodiment can be realized.

Figure 12:
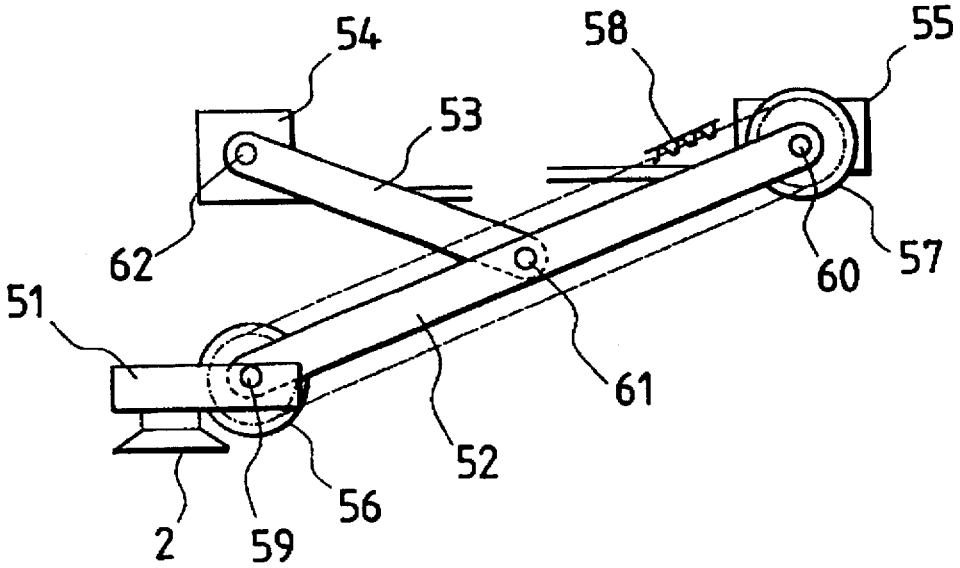
FIG. 12 is a side view of a link mechanism unit according to the third embodiment of the present invention.

FIG. 12 is a partial side view of a link mechanism unit of a sheet supply device according to the third embodiment of the present invention. In this embodiment, no arms corresponding to the arms 8 of the first embodiment are used. In place of the arms 8, the posture of each suction pad is regulated using a toothed pulley 56 fixed to each suction pad holding member 51, a toothed belt 58 looped on the pulley 56, and a toothed pulley 57 on which the other end of the belt 58 is looped, to have the position of a pin 59 as the center. The two toothed pulleys 56 and 57 have the same number of teeth. The toothed pulley 57 can be controlled by a driving source (not shown) to be freely pivoted or fixed. When the toothed pulley 57 is fixed, each suction pad 2 maintains a constant posture regardless of the expansion/contraction and horizontal movement of the arms. On the other hand, when the toothed pulley 57 is rotated, the posture of each suction pad can be changed. For example, when a sheet is to be drawn by suction, each suction pad is held in a horizontal state, and is reciprocally moved in an arcuated path to have the shaft 59 as the center while being moved upward, thereby removing a sheet inadvertently fed together with the uppermost sheet. When the sheet sucked by the suction pads is to be inserted between the rollers, each suction pad can be set at an angle other than a horizontal state, and can be moved in an oblique direction accordingly. Portions other than the toothed belt, i.e., arms 52 and 53, pins 59, 60, 61, and 62, and slide plates 54 and 55 correspond to the components 7, 9, 15, 17, 20, 21, 10, and 11 of the first embodiment, respectively, and have the same functions. A portion for driving the slide plates 54 and 55 is the same as that in the first embodiment, and is not shown in FIG. 12.

Figure 13:
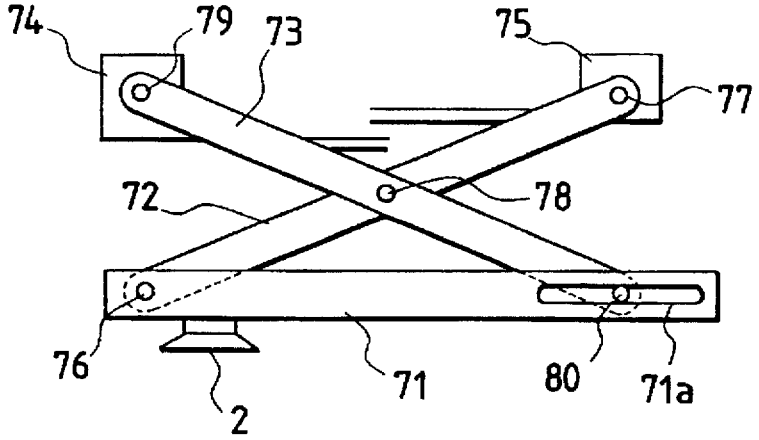
FIG. 13 is a side view of a link mechanism unit according to the fourth embodiment of the present invention.

FIG. 13 is a side view of a link mechanism unit of a sheet supply device according to the fourth embodiment of the present invention. This embodiment corresponds to a modification of the link arrangement. Each suction pad 2 is fixed to a suction pad holding member 71. The suction pad holding member 71 is fixed to the lower ends of two arms 72 and 73 having an equal inter-axis distance via pins 76 and 80. The pin 76 is rotatably fixed to a round hole of the suction pad holding member 71, and the pin 80 is slidably fixed to a guide groove 71*a* of the member 71. The intersecting portions of the arms 72 and 73 are rotatably coupled via a pin 78. The upper ends of the arms 72 and 73 are pivotally fixed to slide plates 75 and 74 via pins 77 and 79. The slide plates 74 and 75 have the same functions as those of the plates 10 and 11 of the first embodiment. A portion for driving the slide plates 74 and 75 is the same as that in the first embodiment, and is not shown in FIG. 13. With this arrangement, the number of arms can be reduced to two without using any toothed belt, and the like.

Figure 14:
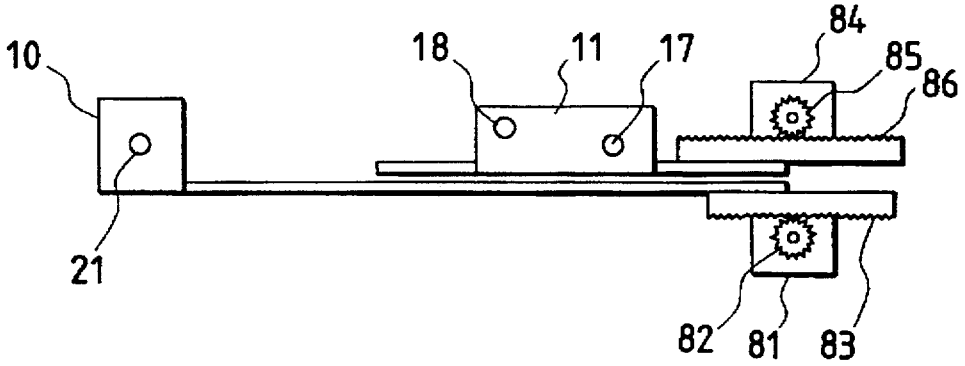
FIG. 14 is a side view of a slide plate driving unit according to the fifth embodiment of the present invention.

FIG. 14 is an explanatory view of a slide plate driving unit of a sheet supply device according to the fifth embodiment of the present invention, i.e., a side view showing a modification of the driving mechanism of the slide plates 10 and 11. Racks 83 and 86 are respectively attached to the slide plates 10 and 11, as shown in FIG. 14, and respectively mesh with gears 82 and 85 attached to the output shafts of different driving sources 81 and 84. The link mechanism unit and the arrangement of the suction pad portions are the same as those in the first embodiment. The slide movement is controlled by the driving sources 81 and 84 to attain the same movement as in the first embodiment. With the above arrangement for driving the slide plates using different driving sources, the degree of freedom upon movement control of the slide plates 10 and 11 can be increased.

Figure 15:
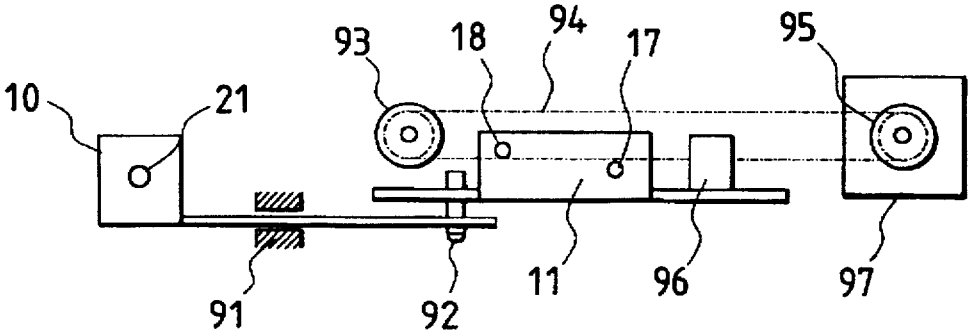
FIG. 15 is a side view of a slide plate driving unit according to the sixth embodiment of the present invention.

FIG. 15 is an explanatory view of a slide plate driving unit of a sheet supply device according to the sixth embodiment of the present invention, i.e., a side view showing another modification of the driving mechanism of the slide plates 10 and 11. If the directions to operate the suction pads are limited to the up-and-down direction and the right-and-left direction in the link mechanism shown in FIG. 4, when the suction pads are to be moved in the up-and-down direction, the slide plate 10 is fixed, and the slide plate 11 is slid; when the suction pads are to be moved in the right-and-left direction, the two slide plates are integrally slid. In consideration of these operations, a brake 91 for fixing the slide plate 10, and a coupling pin 92 which can freely couple or release the slide plates 10 and 11 are arranged. The coupling pin 92 is fixed to the slide plate 11 to be slidable in the up-and-down direction, and can be moved in the up-and-down direction by a driving source (not shown). FIG. 15 illustrates a state wherein the lower end of the coupling pin 92 extends through a hole (not shown) formed in the slide plate 10 to couple the slide plates 10 and 11 each other. When the coupling pin 92 is released from the slide plate 10, the frictional brake 91 contacts the slide plate 10 to fix it in position. A toothed belt 94 meshes with a toothed pulley 95, which is attached to the output shaft of a driving source 97 fixed to a board (not shown), and a toothed pulley 93, which is pivotally fixed to the board (not shown). The toothed belt is coupled to the slide plate 11 via a metal fixing member 96. With this arrangement, when the slide plates 10 and 11 are to be integrally moved, the frictional brake 91 is released, and the coupling pin extends through the slide plates 10 and 11, and when only the slide plate 11 is to be moved, the coupling pin is released from the slide plate 10 and the frictional brake 91 is activated. With this arrangement, the driving source can be appropriately transmitted to the two slide plates.

In the above embodiment, the coupling pin may be replaced by another coupling means, e.g., means for attaining a coupling state by means of a frictional force or magnetic force. The frictional brake may be replaced by another holding means. For example, a mechanism similar to the coupling pin, or a magnetic force may be used.

Figure 16A:
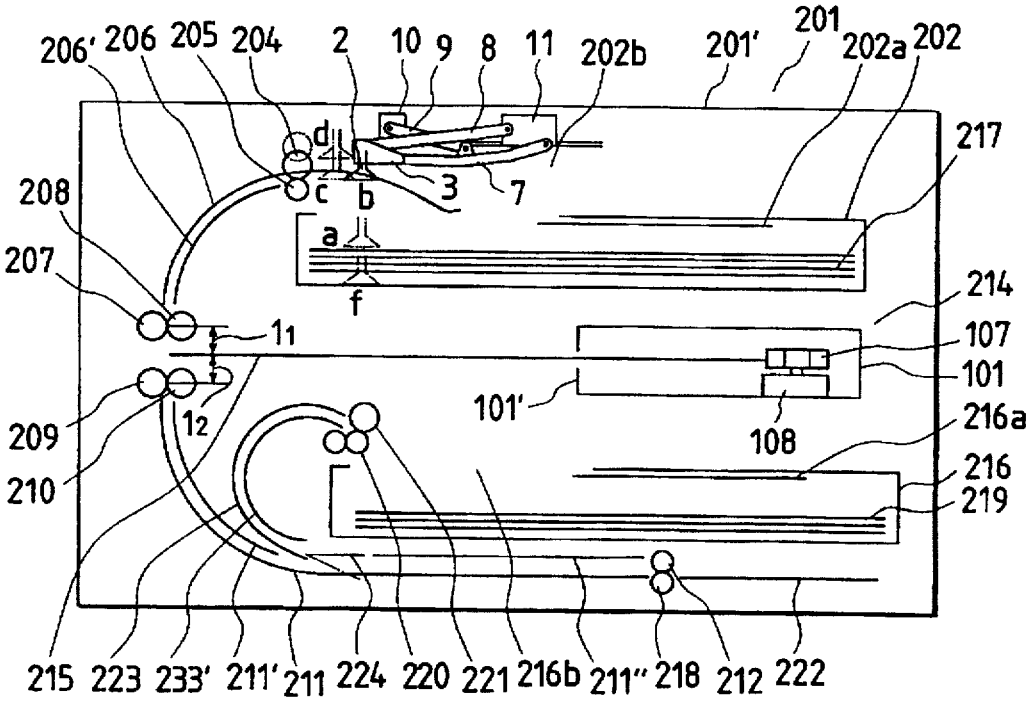
FIGS. 16A and 16B are explanatory views of an image recording apparatus using the present invention, and its scanning optical unit.
Figure 16B:
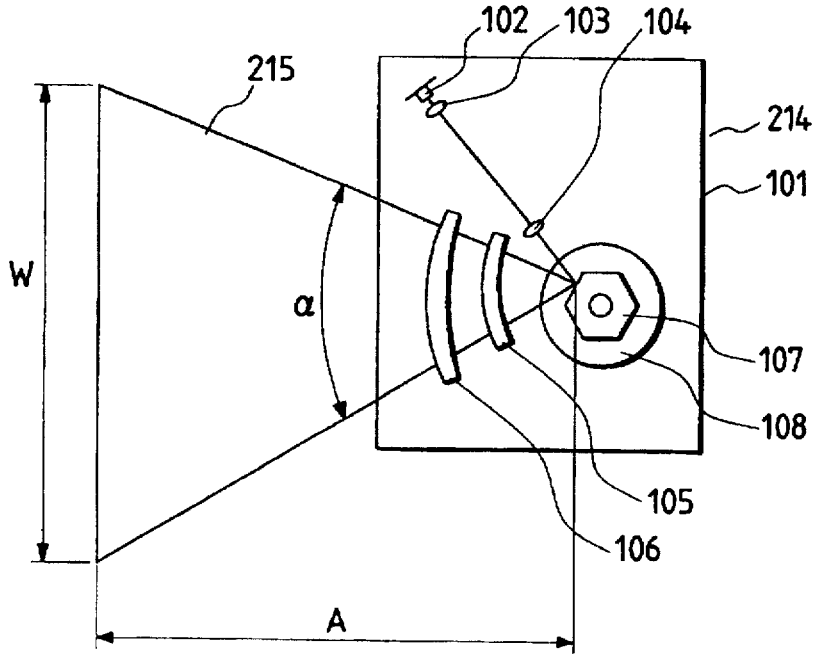

FIGS. 16A and 16B show the arrangement obtained when one of the sheet supply devices of the above embodiments is assembled in an image recording apparatus. FIG. 16A is a sectional view showing the entire arrangement, and FIG. 16B is a plane view of an optical unit. FIGS. 16A and 16B illustrate the arrangement in which the sheet supply device of the first embodiment is assembled, and the same reference numerals in FIGS. 16A and 16B denote the same parts as in FIGS. 3 and 4. Referring to FIG. 16A, a recording apparatus main body 201 records a digital image obtained by a medical image generator such as a CT, MRI, or the like on a film using a scanning optical system. A cover 201' covers the main body 201 in an optically shielded state, and includes a supply magazine 202 which stores a stack of non-used films 217, and a receive magazine 216 which stores recorded films 219. The supply magazine 202 and the receive magazine 216 respectively have openings **202*b* and 216*b* through which films can enter/exit, and lids 202*a* and 216*a* are respectively attached to the supply magazine 202 and the receive magazine 216 to freely open/close. When these lids 202*b* and 216*b*** are closed, the interiors of these magazines are kept in an optically shielded state. Therefore, the two magazines which include films can be unloaded outside the apparatus without exposing films.

FIG. 16B is a plane view of a scanning optical unit 214. Referring to FIGS. 16A and 16B, a cover 101 covers an optical system to protect it, and to prevent dust from entering the optical system. The cover 101 has an opening 101' so as not to disturb passage of a light beam 215. A laser 102 irradiates a light beam which is intensity-modulated in accordance with image data. Lenses 103, 104, 105, and 106 convert the light beam into one having predetermined characteristics. A rotary polygonal mirror 107 is rotated by a motor 108 at a predetermined speed to thereby scan the light beam 215 in a substantially fan-shaped path.

Referring to FIG. 16A, one of the suction pads 2 is supported by the suction pad holding member 3 and the arms 7, 8, and 9 as in the mechanism shown in FIGS. 3 and 4, and can be moved to positions a, b, c, and d in FIG. 16A by moving the slide plates 10 and 11. The suction pads 2 draw by suction the uppermost one of films 217 in the supply magazine at the position a, move upward to the position b, and horizontally move to the position c, where the suction pads 2 insert the drawn film between convey rollers 204 and 205. And a controller, not shown, makes the suction pads 2 release suction, so the inserted film comes off the suction pads 2 and hangs down from rollers 204 and 205. The inserted film moves downward in FIG. 16A while being guided along guide plates 206 and 206' by rotating the convey rollers 204 and 205, and its leading edge is inserted between sub-scanning rollers 207 and 208. Thereafter, the convey roller 204 is separated from the film, and is retracted to a position indicated by a dotted line in FIG. 16A. The suction pads 2 are also retracted to the position d not to contact the film. Thereafter, the film is conveyed downward by rotating the sub-scanning rollers 207 and 208 and sub-scanning rollers 209 and 210, i.e., is subjected to a sub-scan, and is irradiated with the light beam 215, i.e., is subjected to a main scan, thus forming a latent image on the film. During this operation, the leading edge of the film passes in guide plates 211 and 211', and reaches convey rollers 212 and 218. After recording, the film is temporarily fed to the right in FIG. 16A by the convey rollers 212 and 218. When the trailing end of the film has passed a movable guide 224, the movable guide 224 moves downward to a dotted line position in FIG. 16A, and the convey rollers 212 and 218 are rotated in the reverse direction. Then, the film is fed to the left in FIG. 16A, and reaches storage rollers 220 and 221 while being guided along guide plates 223 and 223'. Finally, the film is stored in the receive magazine 216. When the recorded film is developed by another apparatus, a visible image is formed on the film.

The mechanism for reducing the pressure of the inner space of each suction pad 2 may comprise an electromagnetic pump, or the like, or may comprise another known method. In this case, each suction pad is provided with an evacuation port (not shown), which is connected to a pressure-reduction means (not shown) via a hollow pipe (not shown). The pressure-reduction means may also be realized as follows. That is, an arrangement as a combination of a cam (not shown) coaxially attached to the cam disk (FIG. 3) for driving the slide plates 10 and 11, and a lever is used. Upon operation of the cam and lever, a flexible chamber connected to each suction pad is squeezed, and each suction pad is brought into contact with a sheet while holding the squeezed state of the chamber. After the suction pad contacts the sheet, the squeezed state of the chamber is released, and the capacity of the chamber is increased by the restoration force of a spring (not shown) to reduce the pressure inside the chamber, thereby drawing the sheet by suction. After the suction pad which draws the sheet by suction is moved to the positions a, b, and c, and inserts the sheet between the convey rollers, the chamber is squeezed by operating the cam and lever again to release the sheet. The chamber is fixed in the contracted state to prepare for the operation for drawing the next sheet by suction.

A similar sheet convey mechanism may be assembled in an image reading apparatus in which the scanning optical system 214 is replaced by a known reading system as a combination of an illumination system and a detection system such as a line CCD.

Furthermore, various modifications of the present invention may be made as follows, for example:

A plurality of suction pads may be attached to a single suction pad holding plate.

As a modification of the first embodiment, shafts 17 and 18 for fixing the upper ends of the arms 7 and 8 may be attached to a member, which is fixed to the slide plate to be pivotal about a certain position of the shaft 17. In this case, by pivoting this member, the posture of each suction pad can be changed.

As another modification of the first embodiment, when the posture of each suction pad is to be changed in correspondence with expansion/contraction of the arms, the parallelogram defined by the arms 7 and 8, the suction pad holding member 3, and the slide plate 11 may have different long or short side lengths.

As a modification of the third embodiment, when the posture of each suction pad is to be changed in correspondence with expansion/contraction of the arms, the two toothed pulleys 56 and 57 may have different numbers of teeth.

In the above embodiments, sheets are placed horizontally, but may be placed obliquely or in an almost vertical direction.

The following effects can be expected according to the devices of the above-mentioned embodiments:

Since the suction pad can be moved in the vertical, horizontal, and oblique directions, and the like by only linearly moving the other-end portions of the two arms, the mechanism is simple, and control is easy.

Since the mechanism portion is simple, the device can be rendered compact. If two arm holding means have a planar shape, they can be stacked to linearly move in the same moving direction. For this reason, the thickness of the device (in a direction perpendicular to sheets) can be reduced.

Since the mechanism portion is simple and the device can be rendered compact, the device cost can be reduced.

By selecting the lengths and the like of arms, the moving range, moving path, posture, and the like of the suction pad can be selected, resulting in a high degree of freedom of design.

Since a second arm is coupled to a substantially middle point between the coupling portion between a first arm and the holding portion, and the other end of the first arm, when the other end of the second arm is fixed, and the other end of the first arm is moved, the suction pad can be moved in only a direction perpendicular to the moving direction of a holding means; when the two arms are integrally moved, the suction pad can be moved in only the moving direction of the holding means, resulting in easy control.

Since a posture regulating means has a third arm which has one end pivotally fixed to the holding portion and the other end pivotally fixed to a portion where the other end of the first arm is pivotally fixed, a simple, inexpensive mechanism having a small number of components can be realized.

Since the third arm and the first arm have an equal distance between the pivotally fixed portions at their two ends, the position of the suction pad can always be held horizontally or at an arbitrary angle by a simple mechanism.

Since the position regulating means comprises a toothed belt and a toothed pulley, the number of sliding portions can be reduced, thus providing a low-noise device with high durability. In addition, the number of portions that require lubrication is reduced. By changing the numbers of teeth of the two toothed pulleys, the posture of the suction pad can be easily changed.

When the driving means comprises a cam, complex moving paths of the suction pad can be obtained by simple operations, i.e., by rotating the cam through a given angle or reversing the cam as long as the cam shape is selected appropriately. By reducing the angle of friction of the cam, a large driving force can be obtained. When two cams are arranged on a common shaft, they can be driven by a common driving source.

When the driving means comprises a rack, the moving speed and driving force can be easily selected by changing the combinations of the numbers of teeth. In addition, the moving distance can be easily prolonged, and the number of sliding portions can be reduced. The use of a rack is preferable especially when two independent driving sources are used.

When the driving means comprises a toothed belt, noise can be reduced, the number of sliding portions can be reduced, and also, the number of portions that require lubrication can be reduced. By changing the number of teeth of a pulley, the moving speed and driving force can be easily selected.

When the driving means comprises a single driving source, an inexpensive device can be realized due to a small number of driving sources, and control is facilitated.

When the driving means comprises driving sources for independently driving the other-end portions of the first and second arms, the degree of freedom of control can be increased, and precise control can be realized. Such an arrangement is suitable for a case wherein the moving paths of the suction pads are complex.

When the driving means comprises a coupling means for fixing the positional relationship between the other-end portions of the first and second arms, means for driving the first and second arms while the positional relationship between the other-end portions of the first and second arms is fixed by the coupling means, and holding means for holding the position of the other end of the second arm when the coupling means is released, the number of driving sources can be reduced.

When the posture regulating means comprises a driving means for changing the posture of the suction pad, the degree of freedom of control can be increased, and precise control can be realized. Such an arrangement is suitable for a case wherein the moving paths of the suction pads are complex.

Figure 17:
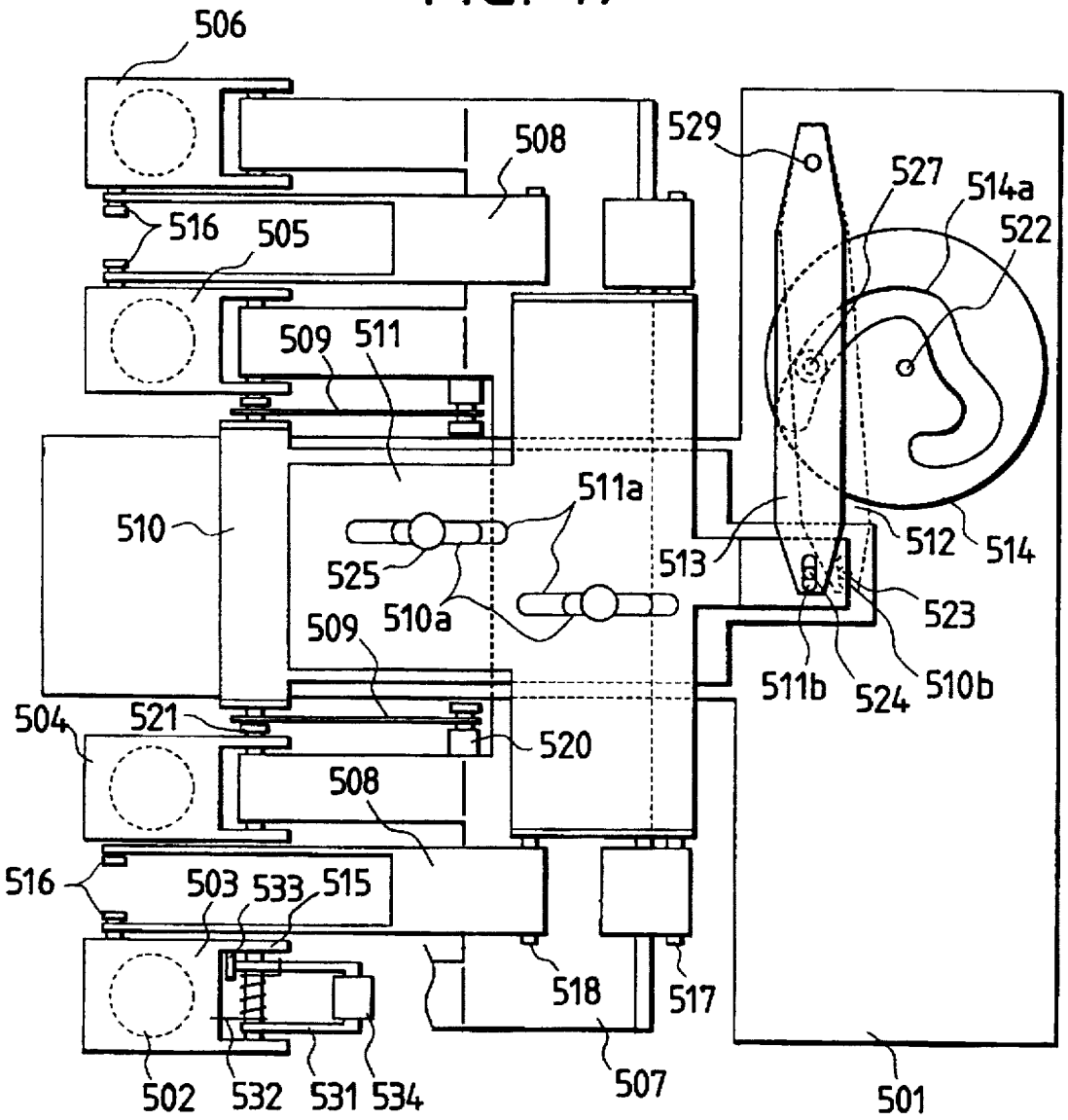
FIG. 17 is a plane view of a sheet supply device according to the seventh embodiment of the present invention.
Figure 18:
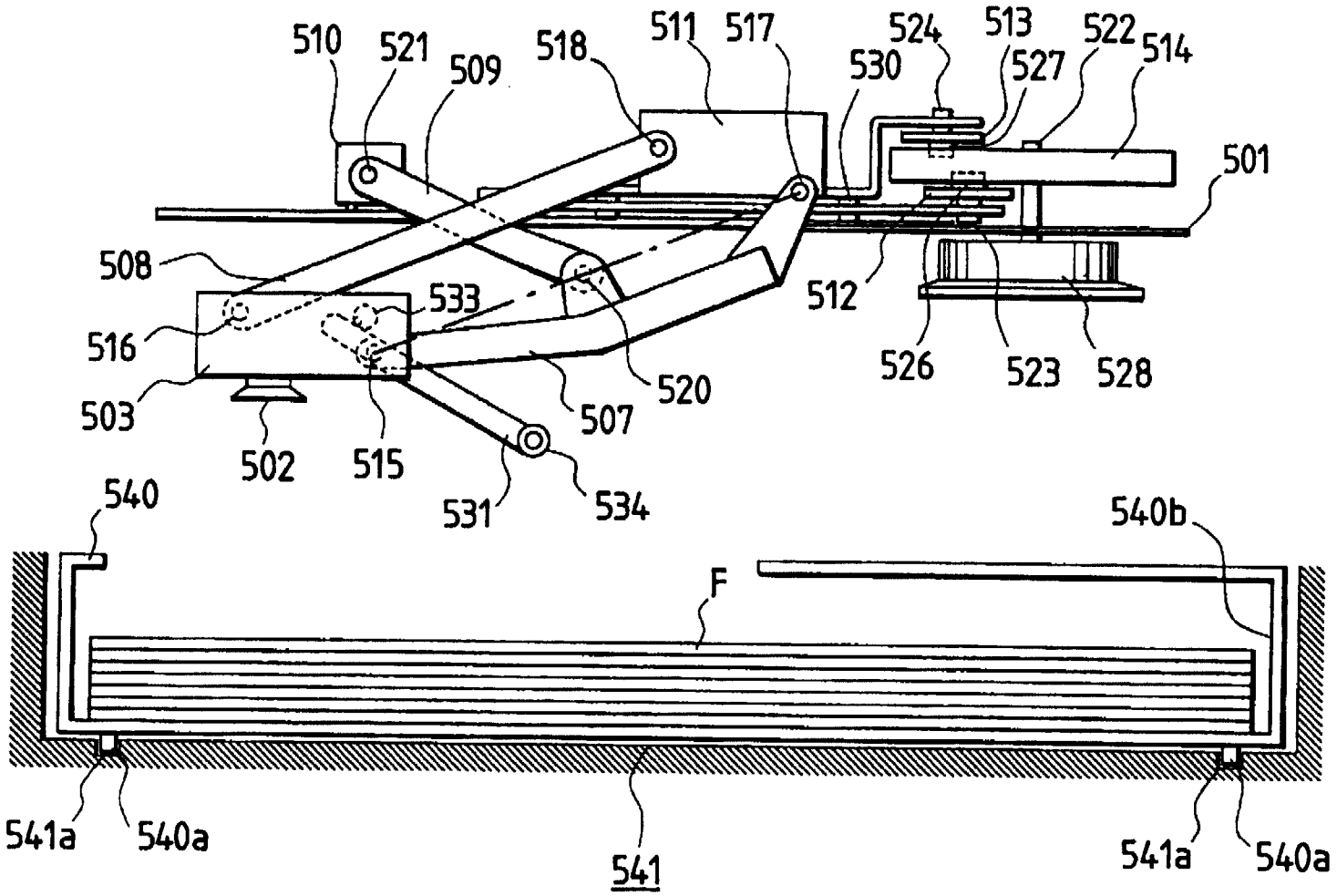
FIG. 18 is a side view of the sheet supply device according to the seventh embodiment of the present invention.

FIG. 17 is a plane view of a sheet supply device according to the seventh embodiment of the present invention, and FIG. 18 is a side view of the device. The arrangement of the device will be described below with reference to FIGS. 17 and 18. Referring to FIGS. 17 and 18, a board 501 holds respective components of the sheet supply device. Each of suction pads 502 has an exhaust port (not shown), which is connected to a pressure-reduction means such as an electromagnetic pump via a hose (not shown). The pressure inside each suction pad 502 is reduced when the suction pads 502 contact a sheet, thereby holding the sheet by suction. The suction pads 502 are respectively fixed to suction pad support members 503, 504, 505, and 506. The lower ends of arms 507 and 508 are pivotally fixed to the suction pad support members 503, 504, 505, and 506 via pins 515 and 516. The upper ends of the arms 507 and 508 are fixed to an upper slide plate 511 via pins 517 and 518. The interval between the pins 515 and 517 is equal to that between the pins 516 and 518. Also, the interval between the pins 515 and 516 is equal to that between the pins 517 and 518. More specifically, the suction pad support member 503, the arms 507 and 508, and the upper slide plate 511 form a parallelogram link mechanism. Therefore, even when the arms 507 and 508 rotate, the suction pads 502 are always parallel to the board 501. The lower ends of arms 509 are pivotally fixed to the arm 507 via pins 520, and their upper ends are pivotally fixed to a lower slider plate 510 via pins 521. The position of each pin 520 corresponds to the middle point of a straight line connecting the pins 515 and 517, and the interval between the pins 520 and 521 is equal to half the interval between the pins 515 and 517. The lower slide plate 510 has two elongated hole portions 510*a*, and the upper slide plate 511 similarly has two elongated hole portions 511*a*. Pins 525 extend through the corresponding elongated hole portions 510*a* and 511*a*. Spacers 530 with good slidability are inserted in a contact portion between the board 501 and the lower slide plate 510, and a contact portion between the lower and upper slide plates 510 and 511. Therefore, the slide plates 510 and 511 are fixed to the board 501 to be independently slidable in the right-and-left direction in FIGS. 17 and 18. The slide plates 510 and 511 respectively have elongated hole portions 510*b* and 511*b* on their right end portions, and pins 523 and 524, which are fixed to the lower ends of levers 512 and 513, are respectively fitted in these elongated hole portions 510*b* and 511*b*. The levers 512 and 513 are fixed to the board 501 to be independently pivotal about a shaft 529. A cam disk 514 is fixed to the board 501 to be pivotal about a shaft 522. A cam groove 514*a* is formed on the upper surface of the cam disk 514. A cam follower 527 fixed to the lever 513 is fitted in the groove 514*a*. Similarly, another cam groove is formed on the lower surface (not shown) of the cam disk 514, and a cam follower 526 fixed to the lever 512 is fitted in this groove. A toothed pulley 528 is fixed to the lower end of the shaft 522. A toothed belt (not shown) is looped on the pulley 528, and rotates a rotating shaft upon reception of a driving force from a driving source (not shown), which is controlled by a control circuit (not shown), thereby rotating the cam disk. A swing arm 531 is biased clockwise in FIG. 18 by a coil spring 532. A stopper pin 533 contacts one end of the swing arm 531 to regulate the pivotal movement of the arm, thereby regulating the position of the swing arm 531 at a predetermined angle with respect to a stack of sheets stored in a storage case 540. An elastic rubber member 534 is attached to the other end of the swing arm 531, and has the following positional relationship. That is, when the device of this embodiment is brought close to the storage case 540 to pick up by suction and convey one of stacked sheets stored in the case, the rubber member 534 initially contacts the sheet. On the other hand, a device main body which incorporates the storage case 540 is provided with a case storage unit 541 which can load the storage case 540, and the storage unit 541 is formed with a groove 541*a* for receiving a projection 540*a* projecting from the bottom portion of the storage case 540. Furthermore, the groove 541*a* is formed parallel to the main scanning line of a laser beam in an image recording unit (not shown). Therefore, when a side wall 540*b* of the storage case 540 is set to be parallel to the projection 540*a*, the side wall 540*b* can be consequently set to be parallel to the main scanning line of the laser beam.

With the above-mentioned arrangement, when the lower slide plate 510 is fixed and the upper slide plate 511 is slid in the right-and-left direction in FIGS. 17 and 18, the suction pad support member 503 moves in only the up-and-down direction in FIG. 18 with respect to the storage case 540. When the lower and upper slide plates 510 and 511 are simultaneously moved in the same direction as if they were integrated, the suction pad support member 503 moves in only the right-and-left direction. When the upper slide plate 511 is fixed and the lower slide plate 510 is slid, the arm 507 rotates about the pin 517, and the suction pad support member 503 moves in an arcuated path while maintaining a horizontal state. When the upper and lower slide plates 511 and 510 are moved at different speeds, the positions of the suction pads 502 can be changed in the right-and-left direction while moving the suction pads in the up-and-down direction.

The above-mentioned movements of the suction pad support member 503 are determined by the shapes of the cam grooves formed in the upper and lower surfaces of the cam disk for moving the slide plates. An example of the operations of the device of this embodiment will be explained below with reference to FIGS. 19 to 25. FIGS. 19 to 25 are schematic views showing an example of the operation of the embodiment shown in FIGS. 17 and 18, and the same reference numerals in FIGS. 19 to 25 denote the same parts as in FIGS. 17 and 18 although the arms and the like are illustrated simply. FIGS. 19 to 25 illustrate convey rollers 535 and stacked sheets F in addition to the above arrangement.

Figure 19:
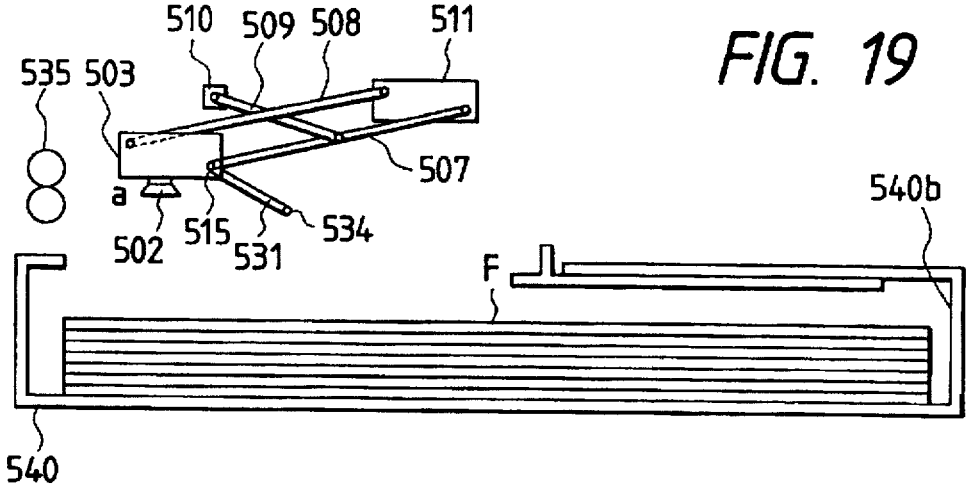
FIG. 19 is a side view for explaining the operation of the sheet supply device according to the seventh embodiment of the present invention.

Referring to FIG. 19, when the storage case 540 is loaded into the storage unit, the suction pad support member 503 initially located above the storage case 540 begins to move downward from a position a upon pivotal motion of the cam disk. Then, the elastic rubber member 534 attached to the end portion of the swing arm 531 contacts a sheet (FIG. 20).

Figure 20:
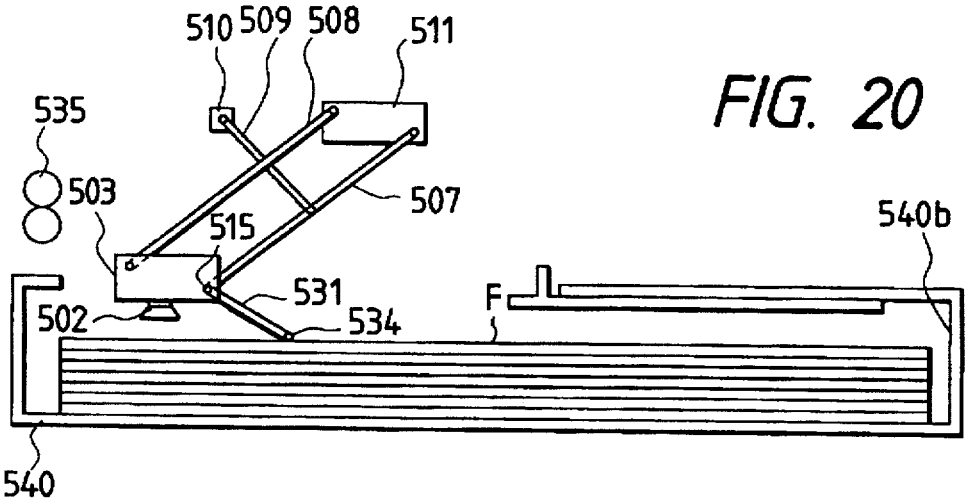
FIG. 20 is a side view for explaining the operation of the sheet supply device according to the seventh embodiment of the present invention.
Figure 21:
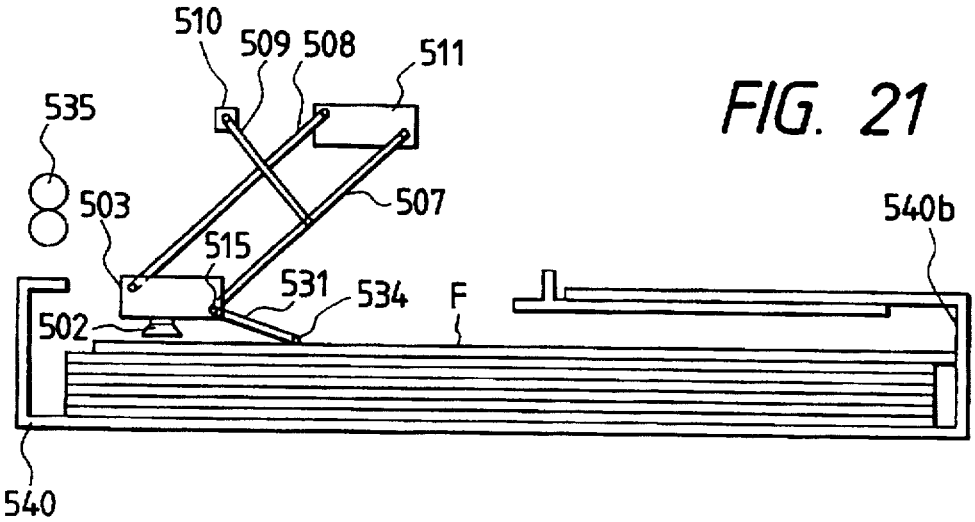
FIG. 21 is a side view for explaining the operation of the sheet supply device according to the seventh embodiment of the present invention.
Figure 22A:
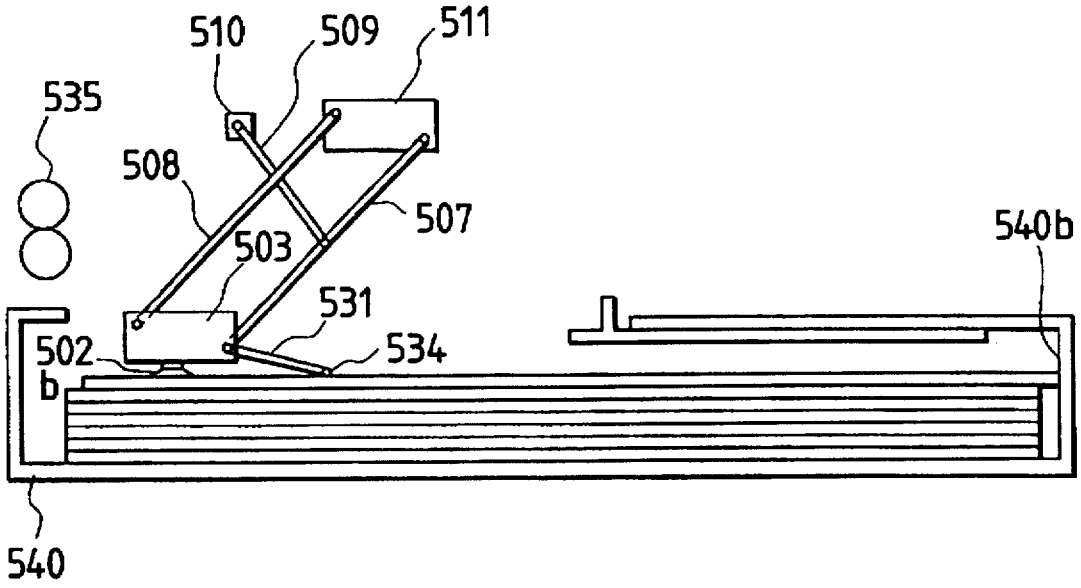
FIGS. 22A, 22B, and 22C are respectively a side view for explaining the operation of the sheet supply device according to the seventh embodiment of the present invention, and detailed views of elastic rubber.
Figure 22B:
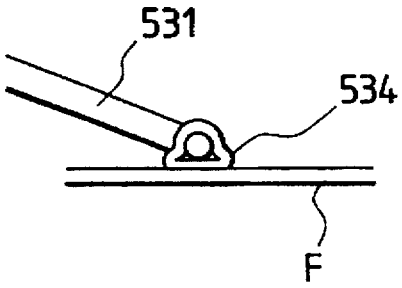
Figure 22C:
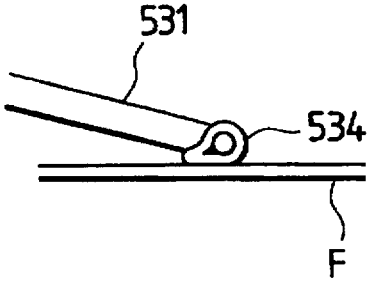
Figure 23:
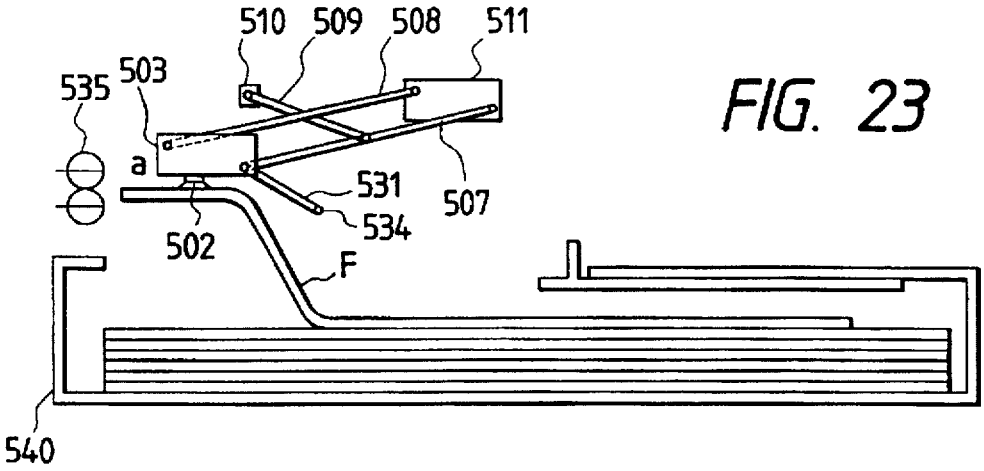
FIG. 23 is a side view for explaining the operation of the sheet supply device according to the seventh embodiment of the present invention.

When the suction pad support member 503 further moves downward, the swing arm 531 begins to pivot counterclockwise in FIG. 20 by the reaction of the stacked sheets F, and a sheet F pressed by the elastic rubber member 534 moves toward the side wall 540*b* (i.e., to the right in FIG. 20) by the pressing force of the coil spring 532 and the proper friction of the elastic rubber member 534 to follow the elastic rubber member 534 upon pivotal motion of the arm 531. At this time, the sheet slidably moves along the underlying sheet. The pressing force of the coil spring 532 is appropriately selected, so that the two sheets do not damage each other upon rubbing. The sheet moves until its end edge in the moving direction contacts the side wall 540*b*. For, at this time, the suction pad 502 does not come to a sheet F, the swing arm 531 is attached to the suction pad support member 503 to have an appropriate angle, so that the moving amount of the elastic rubber member 534 becomes always larger than the allowable moving amount (cluttering of a sheet with respect to the storage case) of the sheet. When the sheet further moves, the end edge of the sheet entirely contacts the side wall 540*b*, and as a result, the sheet is precisely registered to be parallel to the main scanning direction of the laser beam (FIG. 21). Immediately thereafter, the suction pad support member 503 moves downward to a position b, and the suction pad 502 contacts the sheet. The pressure inside the suction pad is reduced by a pressure-reduction means (not shown), so that the suction pad draws the sheet by suction (FIG. 22A). In this case, since the moving amount of the elastic rubber member 534 is larger than that of the sheet, the registered sheet may deform. However, since the elastic deformation of the elastic rubber member 534 absorbs an extra moving amount, the deformation of the sheet can be prevented. FIGS. 22B and 22C show the elastic deformation state of the elastic rubber member 534. FIG. 22B shows a normal state, and FIG. 22C shows a state wherein the extra moving amount is absorbed.

Figure 24:
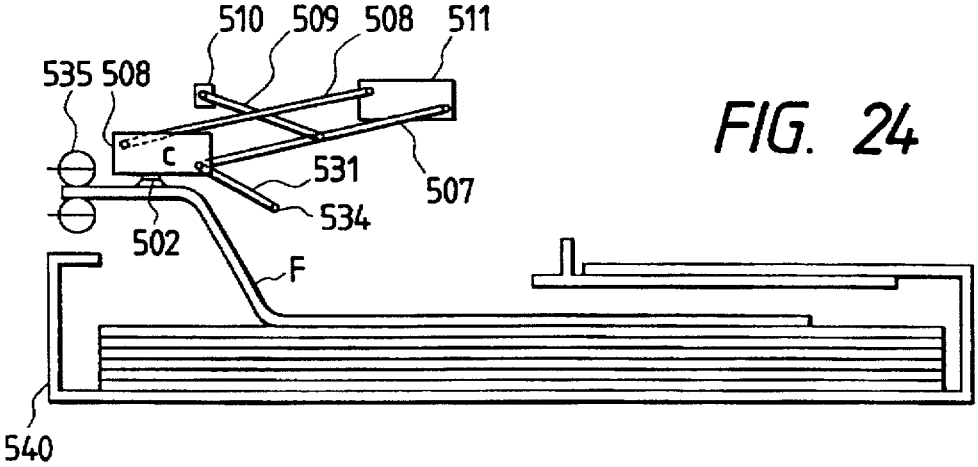
FIG. 24 is a side view for explaining the operation of the sheet supply device according to the seventh embodiment of the present invention.
Figure 25:
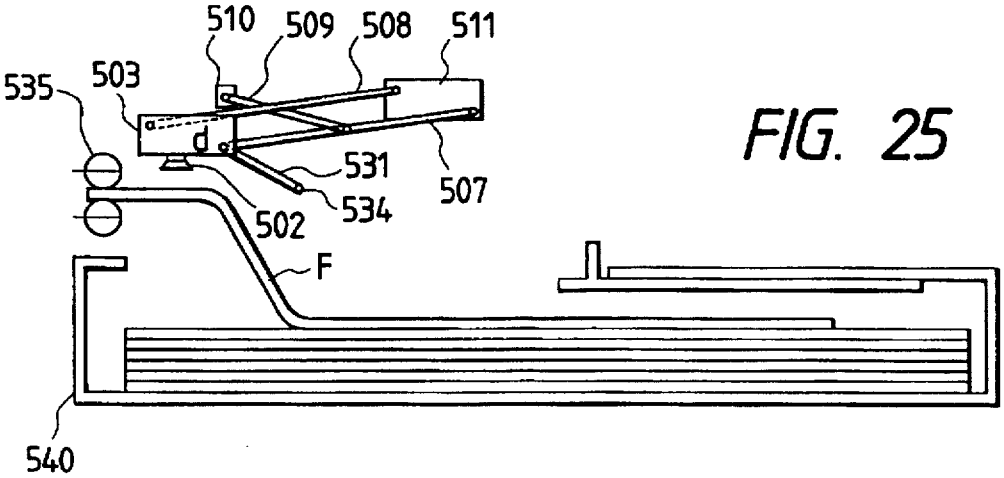
FIG. 25 is a side view for explaining the operation of the sheet supply device according to the seventh embodiment of the present invention.

When the cam disk is reversed in a state wherein the pressure inside the suction pad is reduced by the pressure-reduction means (not shown) and the sheet is picked up by the suction pad, the leading edge of the sheet moves upward to a position a (FIG. 23) at the same level as the nip portion between the convey rollers 535. At this position, a portion, behind the suction pad, of the sheet hangs down due to its weight, and is separated from the elastic rubber member 534. Subsequently, the suction pad 502 horizontally moves to the left in FIG. 23, and inserts the leading edge of the sheet between the convey rollers 535 (FIG. 24). The suction pad then moves upward from the position c to a position d at a desired timing, so as to be retracted from the sheet convey path. Therefore, since the sheet is not affected any convey resistance midway along the convey path of the sheet by the convey rollers 335, it can be conveyed to a recording unit (not shown) or the like while maintaining a horizontal state (FIG. 25).

The suction pads 502 can move downward to a position below the position b, and can sufficiently cover a change in the number of stacked sheets. The timing at which the suction pad moves downward, contacts a sheet, and moves upward after it draws the sheet by suction is controlled using a detection means (not shown).

Figure 26A:
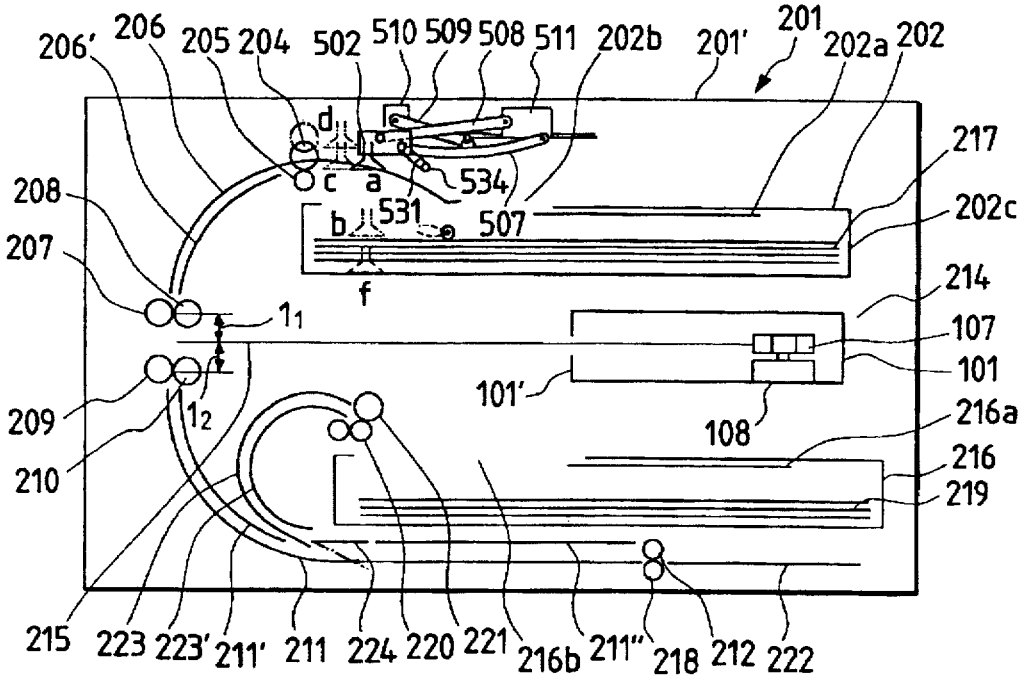
FIGS. 26A and 26B are explanatory views of an image recording apparatus using the present invention, and its scanning optical unit.
Figure 26B:
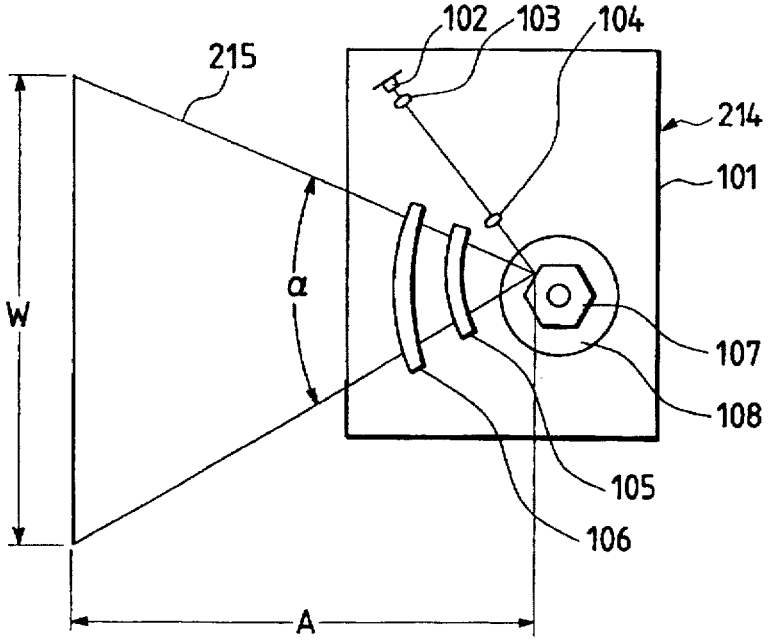

FIGS. 26A and 26B are respectively a side sectional view showing the arrangement of an image recording apparatus in which the sheet supply mechanism of the present invention is assembled, and a plane view of optical members of the apparatus. The same reference numerals in FIGS. 26A and 26B denote the same parts as in FIGS. 16, 17, and 18.

Referring to FIG. 26A, an image recording apparatus main body 201 records a digital image obtained by a medical image generator such as a CT, MRI, or the like on a film using a scanning optical system. A cover 201' covers the main body 201 in a light shielded state, and includes a supply magazine 202 which stores a stack of non-used films 217, and a receive magazine 216 which stores recorded films 219. The supply magazine 202 and the receive magazine 216 respectively have openings 202*b* and 216*b* through which films can enter/exit, and lids 202*a* and 216*a* are respectively attached to the supply magazine 202 and the receive magazine 216 to freely open/close. When these lids 202*b* and 216*b* are closed, the interiors of these magazines are kept in a light shielded state. Therefore, the two magazines which include films can be unloaded outside the apparatus without exposing films.

A scanning optical unit 214 will be described below with reference to the plane view in FIG. 26B. A cover 101 covers an optical system to protect it, and to prevent dust from entering the optical system. The cover 101 has an opening 101' so as not to disturb passage of a light beam 215. A laser 102 irradiates a light beam which is intensity-modulated in accordance with image data. Lenses 103, 104, 105, and 106 convert the light beam into one having predetermined characteristics. A rotary polygonal mirror 107 is rotated by a motor 108 at a predetermined speed to scan the light beam 215 in a substantially fan-shaped path.

The supply magazine 202 is aligned to the recording apparatus 201 by the above-mentioned method of fitting the projection and the groove, and is parallel to the main scanning line of the light beam 215. Therefore, when a side wall 202*c* of the supply magazine 202 is set to be parallel to the projection, the side wall 202*c* can be set to be parallel to the main scanning line of the laser beam.

Referring to FIG. 26A, one of the suction pads 502 is supported by the suction pad holding member 503 and the arms 507, 508, and 509 as in the mechanism shown in FIGS. 17 and 18, and can be moved to positions a, b, c, and d in FIG. 26A by moving the slide plates 510 and 511.

The elastic rubber member 534 is attached to the end portion of the swing arm 531. The elastic rubber member 534 moves to follow entrance of the suction pad 502 into the supply magazine, and presses a film. Thereafter, when the elastic rubber member 534 moves to the right in FIG. 26A, it brings the film into contact with the side wall 202*c*, thus registrating the posture of the film. After the registration, the suction pad 502 draws the film by suction, and moves upward to the position a. Thereafter, the suction pad 502 horizontally moves to the position c and inserts the drawn film between convey rollers 204 and 205. The inserted film moves downward in FIG. 26A while being guided along guide plates 206 and 206' by rotating the convey rollers 204 and 205, and its leading edge is inserted between sub-scanning rollers 207 and 208. Thereafter, the convey roller 204 is separated from the film, and is retracted to a position indicated by a dotted line in FIG. 26A. The suction pads 502 are also retracted to the position d not to contact the film.

Thereafter, the film is conveyed downward by rotating the sub-scanning rollers 207 and 208 and sub-scanning rollers 209 and 210, i.e., is subjected to a sub-scan, and is irradiated with the light beam 215, i.e., is subjected to a main scan, thus forming a latent image on the film. During this operation, the leading edge of the film passes in guide plates 211 and 211', and reaches convey rollers 212 and 218. After recording, the film is temporarily fed along a guide 222 to the right in FIG. 26A by the convey rollers 212 and 218. When the trailing end of the film has passed a movable guide 224, the movable guide 224 moves downward to a dotted line position in FIG. 26A, and the convey rollers 212 and 218 rotate in the reverse direction. Then, the film is fed to the left in FIG. 26A, and reaches storage rollers 220 and 221 while being guided along guide plates 223 and 223'. Finally, the film is stored in the receive magazine 216. When the recorded film is developed by another apparatus, a visible image is formed on the film.

In this time, during the supply process of a drawn film, the posture registration process of the film is simultaneously executed, thus shortening one cycle time of the apparatus. Since the second convey path is not required unlike in the prior art, the length of the convey path to the recording unit can become relatively short, thus making the entire apparatus compact. Since the convey unit need only convey a film supplied from the film supply unit to the recording unit, its mechanism is simple.

With the above arrangement, a sheet which runs onto the edge of the storage magazine can be pulled back to a predetermined position in the magazine. In the sheet supply operation, when a sheet is picked up from the magazine using the suction pads, and is supplied to convey rollers, sheets may electrostatically attract each other, and the second sheet which is undesirably picked up simultaneously may run onto the edge of the magazine. In the following supply operation, even when the suction pads attempt to draw a sheet by suction in this state, the sheet is not parallel to the suction pads, and leakage occurs from the peripheral portions of the suction pads, thus causing a suction error.

However, in the above embodiment, since the swing arm 531 and the like can pull back a sheet which runs onto the edge of the magazine into the magazine, the suction operation can be performed in a normal state, and the sheet supply operation can be reliably performed.

In this embodiment, an information recording apparatus has been exemplified. Alternatively, a similar sheet convey mechanism may be assembled in an image reading apparatus in which the scanning optical system 214 is replaced by a known reading system as a combination of an illumination system and a detection system such as a line CCD.

Figure 27:
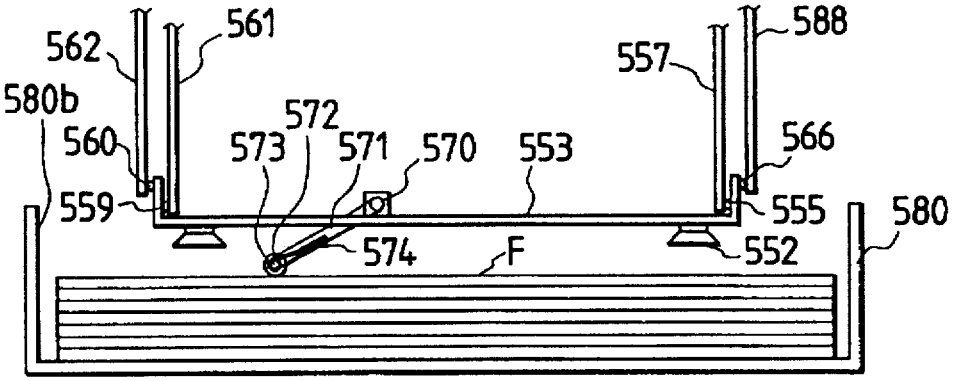
FIG. 27 is a view for explaining the operation of a sheet supply device according to the eighth embodiment of the present invention.
Figure 28:
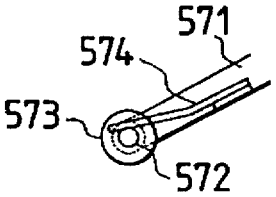
FIG. 28 is a detailed view of a rubber roller of the sheet supply device according to the eighth embodiment of the present invention.
Figure 29:
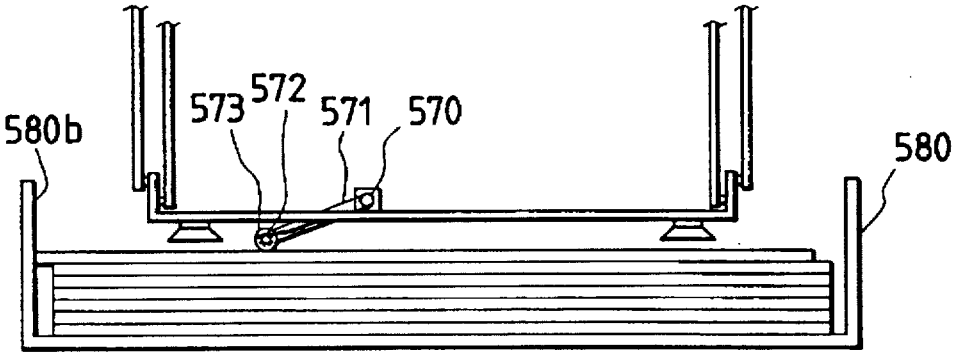
FIG. 29 is a view for explaining the operation of the sheet supply device according to the eighth embodiment of the present invention.

FIG. 27 is a view showing a sheet supply device according to the eighth embodiment of the present invention when viewed from the traveling direction of a sheet. Referring to FIG. 27, suction pads 552 are supported by a suction pad support member 553. As in the parallelogram link mechanism of the above embodiment, the vertical movement and insertion of a sheet between convey rollers (not shown) can be realized by means of levers 557, 558, 561, and 562 which are axially supported by shafts 555, 556, 559, and 560. A swing lever 571 is swingable about a shaft 570 as in the lever 531 in the above embodiment, and is attached to the suction pad support member 553 at a predetermined angle in a direction perpendicular to the traveling direction of the sheet by operations of a spring and pin (neither are shown). A rubber roller 573 is integrally fixed to a shaft 572. The shaft 572 receives an appropriate frictional force from a leaf spring 574. The frictional force is set as follows. That is, when the rubber roller 573 moves while pressing a sheet, the shaft 572 does not pivot; when the roller 573 stops after the sheet contacts a sheet regulating member, the shaft 572 can pivot (FIG. 28). A storage case 580 stores stacked sheets.

The process for starting a suction operation with the above arrangement will be explained below. As in the above embodiment, immediately before the suction pads comes to a sheet, the rubber roller brings a sheet into contact with a side surface **580*b* of the storage case 580 while pressing it. When the side surface 580*b* is set in advance to extend in a direction perpendicular to the scanning line, the posture of the sheet is registrated by the side surface 580*b*. After the registration, since the rubber roller moves while pivoting, it does not deform a sheet or does not change the posture of the sheet. Assuming that the sheet has a rectangular shape (e.g., a 14"×17" size film), and its short side (14") is inserted between the convey rollers upon convey of the sheet, the end edge contacting the side surface 580*b*** upon posture registration is a long side (17"), and posture registration precision can therefore be improved. Thereafter, the sheet drawn by suction by the suction pads is supplied to the convey unit, and an image is recorded or read on or from the sheet.

In the above embodiments, upon posture registraion of a sheet, the sheet is moved backward or sideways with respect to the sheet feed direction. For example, when the swing arm 531 is arranged at a position symmetrical about the pin 515 to move the sheet forward, the same effect can be expected.

Furthermore, if the posture of the sheet is registrated by moving the sheet forward, the following effects can be obtained:

Since the suction position is located in the vicinity of the sheet registration portion (front wall of the magazine), the sheet can be held by suction without changing the registrated posture of the sheet.

Since the distance between the suction pads and the leading edge of the sheet can be stabilized, the insertion amount upon insertion of a sheet between the convey rollers by the suction pads can become constant, thus realizing a more reliable sheet convey operation.

According to each of the embodiments described above, since the posture registration process of a film can be executed during a film pickup process, one cycle time of the apparatus can be shortened. Since the second convey path is not required unlike in the prior art, the length of the convey path to the recording unit can become relatively short, thus making the entire apparatus compact. Furthermore, the registration process can be reliably performed in each pickup operation since it is performed in synchronism with the pickup operation.

What is claimed is:

1. An apparatus for recording or reading information on or from a sheet, comprising:

a holding unit for holding a sheet;

a first arm whose one end is pivotally fixed to said holding unit;

a second arm whose one end is pivotally fixed to said first arm;

a driving system integrally movable with the other end of said first arm and the other end of said second arm, and adapted to change an interval between the other end of said first arm and the other end of said second arm, the driving system having a first mechanism for moving said other end of said first arm and a second mechanism for moving said other end of said second arm, wherein said first mechanism and said second mechanism each has a construction that at least one portion of said first mechanism and that of said second mechanism are stacked in a direction substantially perpendicular to directions of motions of said other end of said first arm and said other end of said second arm and substantially perpendicular to the direction of a center axis around which said second arm is pivoted in relation to said first arm;

a posture regulating mechanism for regulating a posture of said holding unit with respect to said first arm;

a sheet supply unit provided with said holding unit, said first arm, said second arm, said driving system, and said posture regulating mechanism; and a recording or reading unit for performing information recording or information reading on a sheet supplied to said sheet supply unit.

2. An apparatus according to claim 1, wherein said second arm is coupled to a substantially middle point between a coupling portion between said first arm and said holding unit, and the other end of said first arm.

3. An apparatus according to claim 1, wherein said posture regulating mechanism comprises a third arm whose one end is pivotally fixed to said holding unit, and the other end is pivotally fixed to a portion where the other end of said first arm is pivotally fixed.

4. An apparatus according to claim 3, wherein said third arm and said first arm have an equal distance between pivotally fixed portions at two ends thereof.

5. An apparatus according to claim 1, wherein said posture regulating mechanism uses a toothed belt and a toothed pulley.

6. An apparatus according to claim 1, wherein said driving system comprises a cam mechanism.

7. An apparatus according to claim 1, wherein said driving system comprises a rack.

8. An apparatus according to claim 1, wherein said driving system comprises a toothed belt.

9. An apparatus according to claim 1, wherein said driving system comprises a single driving source for driving the other ends of said first and second arms.

10. An apparatus according to claim 1, wherein said driving system comprises driving sources for independently driving the other ends of said first and second arms.

11. An apparatus according to claim 1, wherein said driving system comprises coupling means for releasably fixing a positional relationship between the other ends of said first and second arms, means for driving said first and second arms in a state wherein the positional relationship between the other ends of said first and second arms is fixed, and holding means for holding a position of the other end of said second arm when said coupling means is released.

12. An apparatus according to claim 1, wherein said posture regulating mechanism comprises driving means for changing a posture of said holding unit.

13. An apparatus according to claim 1, further comprising:

a sheet registration member for registrating a posture of a sheet stored in a storage unit in synchronism with movement of said holding unit.

14. A device for supplying a sheet, comprising:

a holding unit for holding a sheet;

a first arm whose one end is pivotally fixed to said holding unit;

a second arm whose one end is pivotally fixed to said first arm;

a driving system integrally moveable with the other end of said first arm and the other end of said second arm, and adapted to change an interval between the other end of said first arm and the other end of said second arm, the driving system having a first mechanism for moving said other end of said first arm and a second mechanism for moving said other end of said second arm, wherein said first mechanism and said second mechanism each has a construction that at least one portion of said first mechanism and that of said second mechanism are stacked in a direction substantially perpendicular to directions of motions of said other end of said first arm and said other end of said second arm and substantially perpendicular to the direction of a center axis around which said second arm is pivoted relative to said first arm; and a posture regulating mechanism for regulating a posture of said holding unit with respect to said first arm.

15. A device according to claim 14, wherein said second arm is coupled to a substantially middle point between a coupling portion between said first arm and said holding unit, and the other end of said first arm.

16. A device according to claim 14, wherein said posture regulating mechanism comprises a third arm whose one end is pivotally fixed to said holding unit, and the other end is pivotally fixed to a portion where the other end of said first arm is pivotally fixed.

17. A device according to claim 16, wherein said third arm and said first arm have an equal distance between pivotally fixed portions at two ends thereof.

18. A device according to claim 14, wherein said posture regulating mechanism uses a toothed belt and a toothed pulley.

19. A device according to claim 14, wherein said driving system comprises a cam mechanism.

20. A device according to claim 14, wherein said driving system comprises a rack.

21. A device according to claim 14, wherein said driving system comprises a toothed belt.

22. A device according to claim 14, wherein said driving system comprises a single driving source for driving the other ends of said first and second arms.

23. A device according to claim 14, wherein said driving system comprises driving sources for independently driving the other ends of said first and second arms.

24. A device according to claim 14, wherein said driving system comprises coupling means for releasably fixing a positional relationship between the other ends of said first and second arms, means for driving said first and second arms in a state wherein the positional relationship between the other ends of said first and second arms is fixed, and holding means for holding a position of the other end of said second arm when said coupling means is released.

25. A device according to claim 14, wherein said posture regulating mechanism comprises driving means for changing a posture of said holding unit.

26. A device according to claim 14, further comprising:

a sheet registration member for registrating a posture of a sheet stored in a storage unit in synchronism with movement of said holding unit.

* * * * *

UNITED STATES PATENT AND TRADEMARK OFFICE

CERTIFICATE OF CORRECTION

PATENT NO. : 5,716,047
DATED : February 10, 1998
INVENTOR(S) : Keiji OHKODA, et al.

It is certified that error appears in the above-identified patent and that said Letters Patent is hereby corrected as shown below:

Column 18, line 25, after "arm;", insert --and--.

Column 19, line 31, after "arm;", insert --and--.

Signed and Sealed this

Eighteenth Day of August, 1998

Bruce Lehman

*Attest:*

BRUCE LEHMAN

*Attesting Officer*

*Commissioner of Patents and Trademarks*